US007419187B2

(12) United States Patent
Haugen et al.

(10) Patent No.: US 7,419,187 B2
(45) Date of Patent: Sep. 2, 2008

(54) DOUBLE KLAP FLEX BASE BOOT WITH HEEL LINKAGE

(75) Inventors: Darrin J Haugen, Seattle, WA (US); John E Svensson, Vashon, WA (US)

(73) Assignee: K-2 Corporation, Seattle, WA (US)

( * ) Notice: Subject to any disclaimer, the term of this patent is extended or adjusted under 35 U.S.C. 154(b) by 166 days.

(21) Appl. No.: 11/084,178

(22) Filed: Mar. 17, 2005

(65) Prior Publication Data

US 2005/0280221 A1 Dec. 22, 2005

Related U.S. Application Data

(63) Continuation-in-part of application No. 10/743,428, filed on Dec. 22, 2003, now Pat. No. 6,921,093, which is a continuation of application No. 10/188,737, filed on Jul. 2, 2002, now Pat. No. 6,666,463, which is a continuation of application No. 09/632,453, filed on Aug. 4, 2000, now abandoned, which is a continuation-in-part of application No. 09/094,425, filed on Jun. 9, 1998, now Pat. No. 6,120,040, which is a continuation-in-part of application No. 08/957,436, filed on Oct. 24, 1997, now Pat. No. 6,082,744.

(51) Int. Cl.
*A63C 1/00* (2006.01)

(52) U.S. Cl. ..... 280/841; 280/11.224; 280/11.27

(58) Field of Classification Search .... 280/11.231–233, 280/11.221, 11.224, 11.19, 11.14, 11.15, 280/841, 11.27, 11.28
See application file for complete search history.

(56) References Cited

U.S. PATENT DOCUMENTS

| | | | |
|---|---|---|---|
| 36,244 | A | 8/1862 | Starr |
| 63,946 | A | 4/1867 | Sanford |
| 601,013 | A | 3/1898 | Evans |
| 609,401 | A | 8/1898 | Beisel |
| 1,228,544 | A | 6/1917 | Falstrem et al. |
| 1,603,588 | A | 10/1926 | Eberle |
| 1,702,316 | A | 2/1929 | Ridgers |
| 1,751,692 | A | 3/1930 | Frühbeis |
| 1,789,182 | A | 1/1931 | Klevstad |
| 2,093,915 | A | 9/1937 | Klevstad |
| 2,120,987 | A | 6/1938 | Murray |
| 2,987,834 | A | 6/1961 | Howe |
| 3,114,562 | A | 12/1963 | Goodman |
| 3,749,413 | A | 7/1973 | Nicolson |
| 3,900,203 | A | 8/1975 | Kukulowicz |

(Continued)

FOREIGN PATENT DOCUMENTS

| | | |
|---|---|---|
| DE | 78 733 | 1/1894 |

(Continued)

*Primary Examiner*—Christopher Ellis
*Assistant Examiner*—Vaughn T Coolman
(74) *Attorney, Agent, or Firm*—Christensen O'Connor Johnson Kindness PLLC

(57) ABSTRACT

A skate includes a midskate hinge in the shoe to preferentially flex the shoe base at the metatarsal area, a forward hinge to allow the rear of the shoe to be raised in relation to the rear of the skate frame, and a third hinge to laterally stabilize the rear of the shoe as the shoe base is flexed.

24 Claims, 22 Drawing Sheets

U.S. PATENT DOCUMENTS

| | | | | |
|---|---|---|---|---|
| 3,936,061 | A | | 2/1976 | Wada |
| 4,061,348 | A | | 12/1977 | Carter |
| 4,107,856 | A | | 8/1978 | Bourque |
| 4,108,450 | A | | 8/1978 | Coté |
| 4,126,323 | A | | 11/1978 | Scherz |
| 4,272,090 | A | | 6/1981 | Wheat |
| 4,470,205 | A | | 9/1984 | Olivieri |
| 4,839,972 | A | | 6/1989 | Pack et al. |
| 5,014,450 | A | | 5/1991 | McGrath |
| 5,184,834 | A | | 2/1993 | Yu |
| 5,228,705 | A | | 7/1993 | Merle-Smith |
| 5,257,793 | A | | 11/1993 | Fortin |
| 5,342,071 | A | | 8/1994 | Soo |
| 5,397,141 | A | | 3/1995 | Hoshizaki et al. |
| 5,435,579 | A | | 7/1995 | Pozzobon |
| 5,484,149 | A | | 1/1996 | Lee |
| 5,498,009 | A | | 3/1996 | Young |
| 5,503,413 | A | | 4/1996 | Belogour |
| 5,505,467 | A | | 4/1996 | Hill et al. |
| 5,586,774 | A | | 12/1996 | Dentale |
| 5,634,648 | A | | 6/1997 | Tonel et al. |
| 5,690,344 | A | | 11/1997 | Chen |
| 5,704,620 | A | | 1/1998 | Oliemans et al. |
| 5,797,608 | A | | 8/1998 | Heldemann |
| 5,842,706 | A | | 12/1998 | Chang |
| 5,890,724 | A | | 4/1999 | Gignoux et al. |
| 5,904,359 | A | | 5/1999 | Caeran et al. |
| 5,904,360 | A | | 5/1999 | Oliemans et al. |
| 5,951,027 | A | | 9/1999 | Oyen et al. |
| 5,957,470 | A | | 9/1999 | Powell |
| 5,961,131 | A | * | 10/1999 | Hilgarth ..... 280/11.231 |
| 5,979,916 | A | | 11/1999 | Gatel et al. |
| 6,007,075 | A | | 12/1999 | Shum |
| 6,082,744 | A | | 7/2000 | Allinger et al. |
| 6,120,040 | A | | 9/2000 | Svensson et al. |
| 6,325,394 | B1 | | 12/2001 | Svensson et al. |

FOREIGN PATENT DOCUMENTS

| | | | |
|---|---|---|---|
| DE | 484 530 | | 10/1929 |
| DE | 488 768 | | 12/1929 |
| DE | 488 740 | | 1/1930 |
| DE | 811 095 | | 8/1951 |
| DE | 25 27 611 | A1 | 12/1976 |
| DE | 35 42 251 | A1 | 6/1987 |
| EP | 0 192 312 | A2 | 8/1986 |
| EP | 0 551 704 | A2 | 7/1993 |
| EP | 0 568 878 | A1 | 11/1993 |
| EP | 0 599 043 | A2 | 6/1994 |
| EP | 0 774 282 | A1 | 5/1997 |
| EP | 0 778 058 | A2 | 6/1997 |
| EP | 0 568 878 | B1 | 2/1998 |
| EP | 0 914 844 | A1 | 5/1999 |
| EP | 0 799 629 | | 12/1999 |
| FR | 2 642 980 | A1 | 8/1990 |
| FR | 2 659 534 | A1 | 9/1991 |
| FR | 2 672 812 | A1 | 8/1992 |
| FR | 2 749 183 | A1 | 12/1997 |
| GB | 505349 | | 5/1939 |
| NL | 8 702 068 | | 4/1989 |
| WO | WO 92/09340 | A1 | 6/1992 |
| WO | WO 92/11908 | A1 | 7/1992 |
| WO | WO 96/37269 | A1 | 11/1996 |
| WO | WO 97/32637 | A1 | 9/1997 |
| WO | WO 97/36655 | A1 | 10/1997 |
| WO | WO 98/47576 | A1 | 10/1998 |
| WO | WO 99/36138 | A1 | 7/1999 |
| WO | WO 00/66232 | A3 | 11/2000 |

* cited by examiner

DOUBLE KLAP FLEX BASE BOOT WITH HEEL LINKAGE

CROSS-REFERENCES TO RELATED APPLICATIONS

This application is a continuation-in-part of U.S. patent application Ser. No. 10/743,428, filed Dec. 22, 2003, which is a continuation of U.S. patent application Ser. No. 10/188,737, filed Jul. 2, 2002, which is a continuation of U.S. patent application Ser. No. 09/632,453, filed Aug. 4, 2000, now abandoned, which is a continuation-in-part of U.S. patent application Ser. No. 09/094,425, filed Jun. 9, 1998, now U.S. Pat. No. 6,120,040, which is a continuation-in-part of U.S. patent application Ser. No. 08/957,436, filed Oct. 24, 1997, now U.S. Pat. No. 6,082,744. All the above applications are incorporated herein expressly by reference.

FIELD OF THE INVENTION

The present invention relates to klap skates and, more particularly, to klap skates with flexible shoe bases.

BACKGROUND OF THE INVENTION

Traditionally, in-line roller skates and ice skates generally include an upper shoe portion secured by a base to a frame supporting wheels or an ice blade. The upper shoe portion provides the support for the skater's foot, while the frame rigidly attaches the wheels or blade to the shoe. When skating on traditional skates, particularly during thrusting, difficulties are encountered in efficiently transferring the thrust from the skater to the ground. The inefficiencies are due in part, to the frame being rigidly attached to the base of the skate, which decreases the effectiveness of the thrust, as well as the comfort for the skater.

Efficiently imparting thrust to the skate during the skating stroke is especially important to speed skaters. Because of the rigid attachment of the frame to the base, speed skaters are coached not to plantarflex their ankle during the push-off phase of the stroke. The term "plantarflex" is commonly used in the art to describe the rotation of the foot relative to the leg, where the fore foot moves distally from the leg. No plantarflexion at the ankle keeps the blade flat on the ice and prevents the tip of the blade from digging into the ice, thereby causing an increase in friction and reducing the skater's speed. If, however, the skater is permitted to plantarflex his or her ankles during the skate stroke, the fore foot will be able to move distally and allow the calf muscles to generate more power during the skate stroke when compared to a stroke where plantarflexion is prevented or discouraged. Thus, a skate that permits ankle plantarflex should allow a skater to generate more power and speed, in addition to reducing the risk of digging the blade's tip into the surface the skater is traversing.

Prior attempts at allowing ankle plantarflexion have resulted in complicated linkage mechanisms that move the instantaneous point of rotation between the boot and blade forward as the heel lifts. Such a linkage mechanism often results in a skate that is too heavy because of the multiple links. Other attempts at permitting ankle plantarflexion have used a single-hinge joint between the blade and boot, thereby hingedly connecting the blade to the boot. The hinge is located below the boot, between the metatarsal head and toe end of the boot. While a single-hinge point attachment system is lighter, current models fail to prevent medial to lateral motion of the blade relative to the boot when the heel is lifted because of a narrow hinge, thus resulting in an unstable skating stroke.

Also, when the heel is lifted, the force from the boot to the blade is transferred through the hinge point. Thus, the skater cannot change the location of the center of pressure on the blade. This produces an unstable platform from which the skater can apply thrust through the blade.

An additional drawback to skates having a single hinge joint stems from the shoe portion of the skate. As briefly noted above, skates traditionally have a boot or shoe portion that has a rigid or semi-rigid base that impedes the foot from flexing at the ball of the foot during the skating motion, thereby restricting the natural movement in the foot, which occurs during locomotion, and preventing a skater from generating the maximum power from the skate stroke.

Thus, there exists a need for a skate that would permit ankle plantarflexion during a skating stroke, that is also lightweight, stable, and a boot that can allow flexion at the ball of the foot. U.S. Pat. No. 6,082,744 to Allinger et al. addresses these issues to overcome the limitations currently encountered by providing a skate that has a first hinge member defined in the metatarsal head region to provide flexing of the shoe base and a second hinge member that is located substantially at the toe end of the boot to allow plantar flexion of the ankle. The second hinge permits the shoe, as a whole, to pivot in relation to the horizontal surface. However, Allinger et al. failed to address the problem of lateral or sideways stability of the shoe in relation to the frame when the skater plantar flexes the ankle. During the skating stroke involving plantar flexing, the heel of the shoe is moved up and away from the frame with the only attachment being at the front of the shoe, making the heel prone to lateral movement. Furthermore, some skaters may desire to have control over which hinge should flex first. The double-hinged skate as described in the '744 patent has the ability to flex both at the shoe base and to flex the shoe, as a whole, with respect to the frame. However, the construction of the skate described in the '744 patent makes it difficult to have control over which hinge flexes first. Some skaters may desire to flex the metatarsal region of the shoe base prior to plantar flexing the entire shoe in order to provide a more natural movement. The present invention provides a flexing shoe base, double hinged skate, capable of plantar flexing with a stabilizing rear heel hinge. Furthermore, the skate in accordance with the present invention, makes it possible for a skater to substantially flex the metatarsal region of the shoe base first, followed by flexing the shoe, as a whole, with respect to the frame.

SUMMARY OF THE INVENTION

The present invention relates to a skate, either an ice skate or an inline skate having a shoe base defining a front and back shoe base portion, a binding member defining a front and back portion, wherein the front portion of the shoe base is connected to the front portion of the binding member, and a frame defining a front and back frame portion, wherein the frame supports gliding means, and the front portion of the frame is connected to the front portion of the binding member. The skate includes first, second, and third hinge members. A first hinge is between the front shoe base portion and the back shoe base portion to permit the back of the shoe to be raised in relation to the back of the binding member. The second hinge is between the front of the binding member and the front of the frame to permit the back of the binding member to be raised in relation to the back of the frame. The third hinge is located between the back of the shoe base and the back of the binding member to stabilize the back of the shoe as the back of the shoe is raised in relation to the back of the binding member. The gliding means can include inline wheels or an ice skating blade.

The present invention relates to a skate boot that is hingedly attached to an elongated bearing member capable of traversing a surface. The boot has an upper shoe portion adapted to receive a foot and a sole defining a heel end, a metatarsal portion having a metatarsal head area, and a toe end. The boot further includes a first hinge member defined in the metatarsal portion thereof to permit the boot to flex in the metatarsal region while the toe end remains substantially parallel with a horizontal plane defined by the bearing member. The boot also includes a second hinge member attached to the sole of the boot, near the toe end, that hingedly attaches the boot to the bearing member. The second hinge member defines a second pivot point, such that as the boot hinges at the second hinge member and about a lateral axis defined relative to the longitudinal direction of the bearing member, the skater is able to push-off from the second hinge member. The boot also includes an elongate frame that is disposed between and attaches the sole of the boot to the bearing member. The skate further includes a third hinge member that connects the rear of the sole of the boot to the rear of the bearing member. The third heel hinge provides lateral stability to the rear of the boot.

In a first embodiment, the upper surface of the frame defines an upwardly projecting mid-boot mount adapted to support the boot at a predetermined location near the metatarsal head area of the sole. The embodiment includes an elongate support plate having a forward end hingedly connected to the frame and a rearward end that extends at least to behind the metatarsal head area of the sole. The mid-boot mount engages the support plate near the metatarsal head area, thereby providing stable support for the support plate. In the embodiment, the mid-boot mount engages the support plate behind the metatarsal head area.

In another aspect of the present invention, the first hinge member includes a heel shell and a fore foot shell. The heel shell is attached to the sole of the boot and defines a forward end and a rearward end. The toe shell is attached to the sole of the boot and defines a rearward end that is hingedly attached to the forward end of the heel shell to permit the boot to flex in the metatarsal head region of the foot, while the toe end of the boot remains substantially parallel with the longitudinal direction of the bearing member.

In a second embodiment, the first hinge member includes a base plate that is attached to the sole of the boot and extends between the toe and heel ends of the boot. The base plate has a natural flexing member defined therein and corresponds to the metatarsal head area of the boot. The natural flexing member permits the boot to flex in the metatarsal portion, while the toe end of the boot remains substantially parallel with the longitudinal direction of the bearing member.

The skate of the present invention provides several advantages over currently available skates. The skate of the present invention provides a first hinge member defined in the metatarsal head area of the upper shoe portion and a second hinge member that pivotally attaches the skate to the skate frame. The first and second hinge members permit the skate to flex in both the metatarsal head area and the toe area of the boot. The skate of the present invention also has the added advantage of permitting the ankle to plantarflex and the fore foot to flex during the skate stroke, thereby permitting a skater to generate more power and, thus, speed. Additionally, plantarflexion prevents the tip of the blade from digging into the ice during the skate stroke. The skate of the present invention is also lighter in weight than those currently available. These advantages combine to define a skate having a double-hinge attachment design to permit skaters to plantarflex their ankle and to flex and extend their toes to generate more power and speed without the tip of the blade digging into the ice.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 13 provides an isometric view of the forward and rearward frame segments of the skate of FIG. 10;

DETAILED DESCRIPTION OF THE PREFERRED EMBODIMENT

Figure 1:
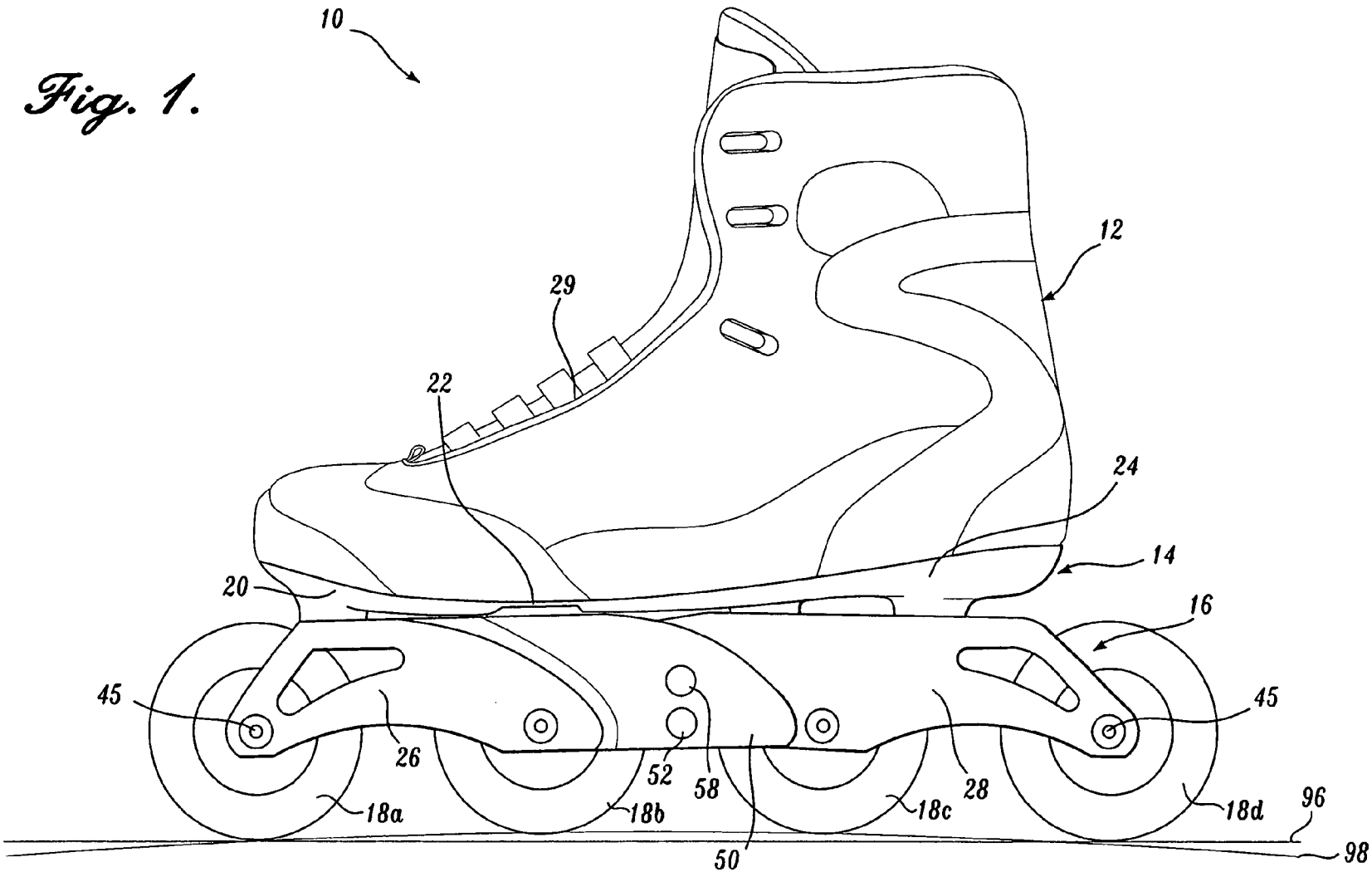
FIG. 1 provides a side view of a skate constructed in accordance with a first embodiment of the present invention, having a flexing base and split frame, with the skate illustrated in the nonflexed and nonloaded configuration.
Figure 2:
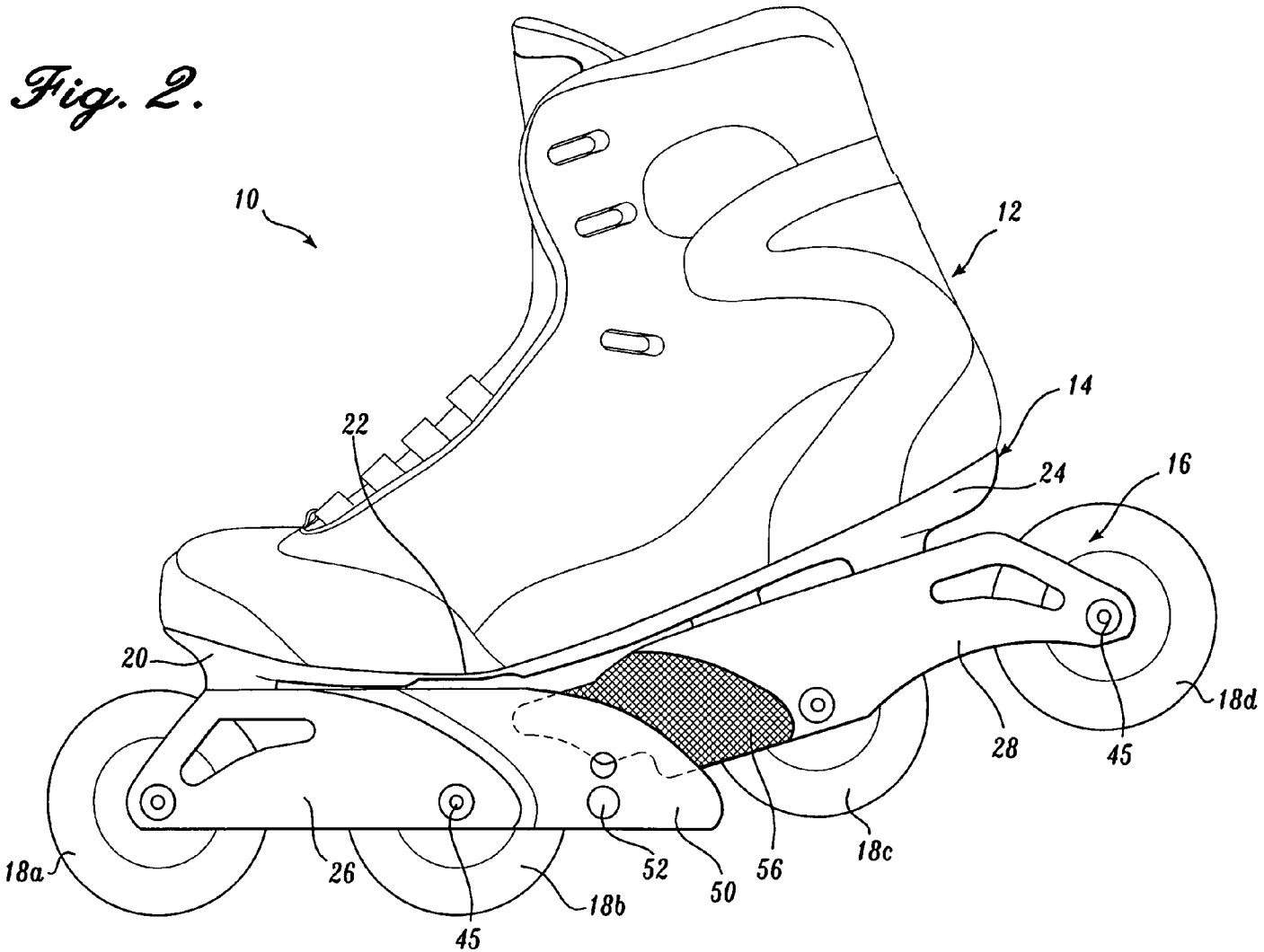
FIG. 2 provides a side view of the skate of FIG. 1 with the skate in the flexed configuration.

A first preferred embodiment of a flexing base skate 10 constructed in accordance with the present invention is illustrated in FIGS. 1 and 2. The skate 10 includes an upper shoe portion 12 that receives and surrounds a skater's foot and ankle, and which is mounted on and secured to a base 14 that is flexible at least at one point along its length. The base 14 underlies and supports the user's foot. The base 14 is in turn secured to a split frame assembly 16 extending longitudinally beneath the base 14. A plurality of wheels 18*a*, 18*b*, 18*c*, and 18*d* are journaled between first and second opposing longitudinal sidewalls of the frame assembly 16.

The base 14 includes a forefoot region 20 that underlies and supports the ball and toes of the user's foot. The forefoot region 20 of the base includes a metatarsal head portion 22 that underlies the zone corresponding to the metatarsal head of a skater's foot. The base 14 extends rearwardly, terminating in a heel region 24 underlying the skater's heel. The frame assembly 16 includes a forward frame segment 26 secured to the forefoot region 20 of the base 14, and a rearward frame segment 28 that is secured to the heel region 24 of the base 14. As used herein throughout, "forward" refers to the direction of the forefoot region 20 of the skate, while the term "rearward" refers to the opposing direction of the heel region 24 of the skate.

The inclusion of a forward frame segment 26 and a rearward frame segment 28, and the formation of the base 14 to permit flexure intermediate of the forward and rearward ends of the base 14, permit the skater's foot and the upper shoe portion 12 to flex during the skating stroke. The base 14 and upper shoe portion 12 flex from a lower position, illustrated in FIG. 1, in which the front and rear frame segments 26, 28 are longitudinally aligned, and a flexed, upper position illustrated in FIG. 2, in which the heel region 24 of the base 14 and rearward frame segment 28 pivot upwardly relative to the forefoot region 20 of the base 14 and forward frame segment 26. Each of the components of the skate 10 will now be described in greater detail.

Referring to FIGS. 1 and 2, the upper shoe portion 12 is of conventional construction, surrounding the toes, sides, heels, and ankle of a user's foot. The upper shoe portion 12 includes a vamp 29, a tongue, and a closure, such as a lace system. The upper shoe portion 12 illustrated is supported by a rigid or semirigid internal heel cup and ankle cuff (not shown), which helps vertically stabilize the skate. Other conventional upper shoe portion constructions are also within the scope of the present invention, including flexible uppers reinforced by external ankle cuffs and heel cups. The upper shoe portion 12 is constructed at least partially from flexible materials so that the upper shoe portion 12 will flex together with the base 14.

Figure 3:
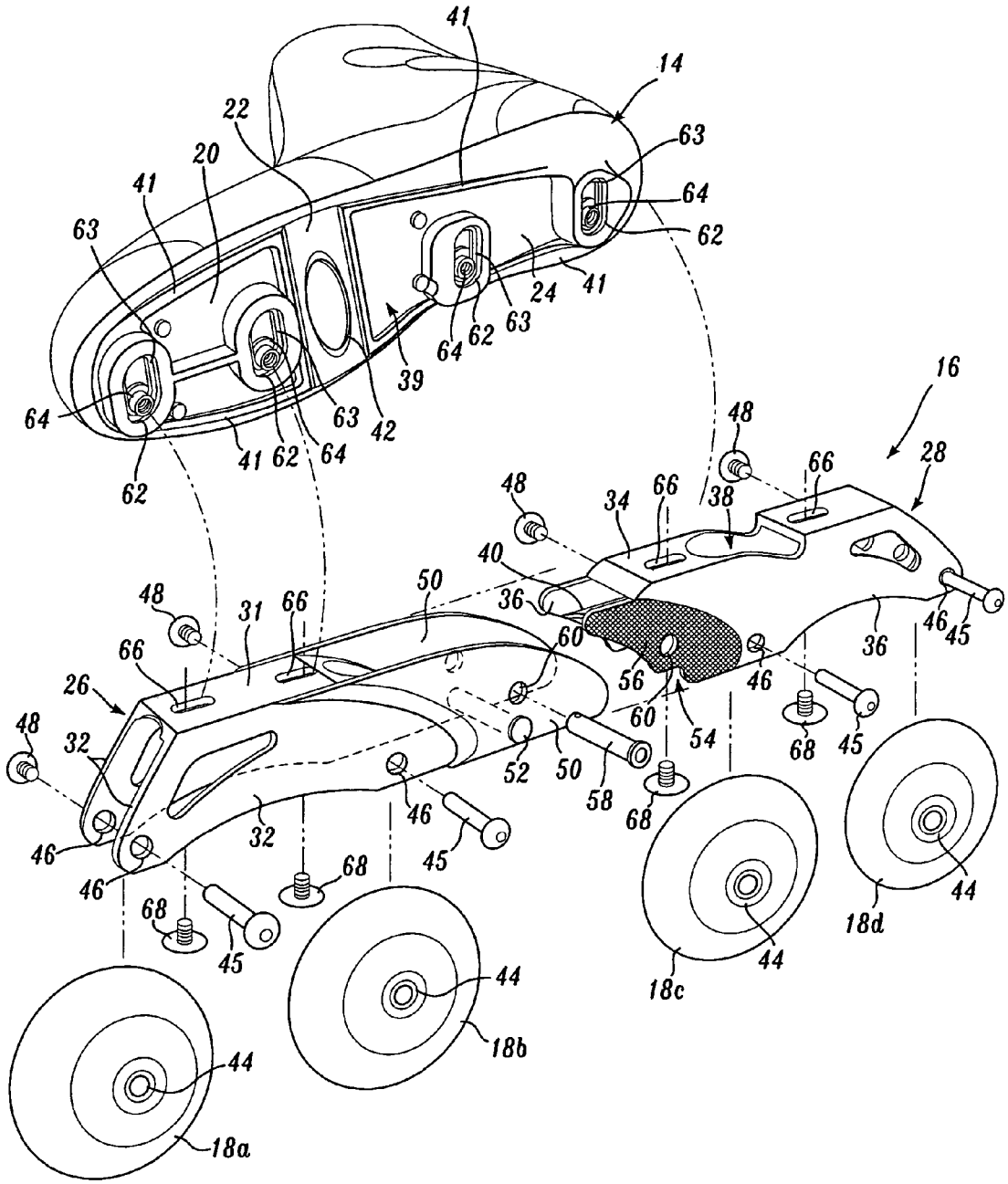
FIG. 3 provides an exploded pictorial view of the skate of FIG. 1.
Figure 4:
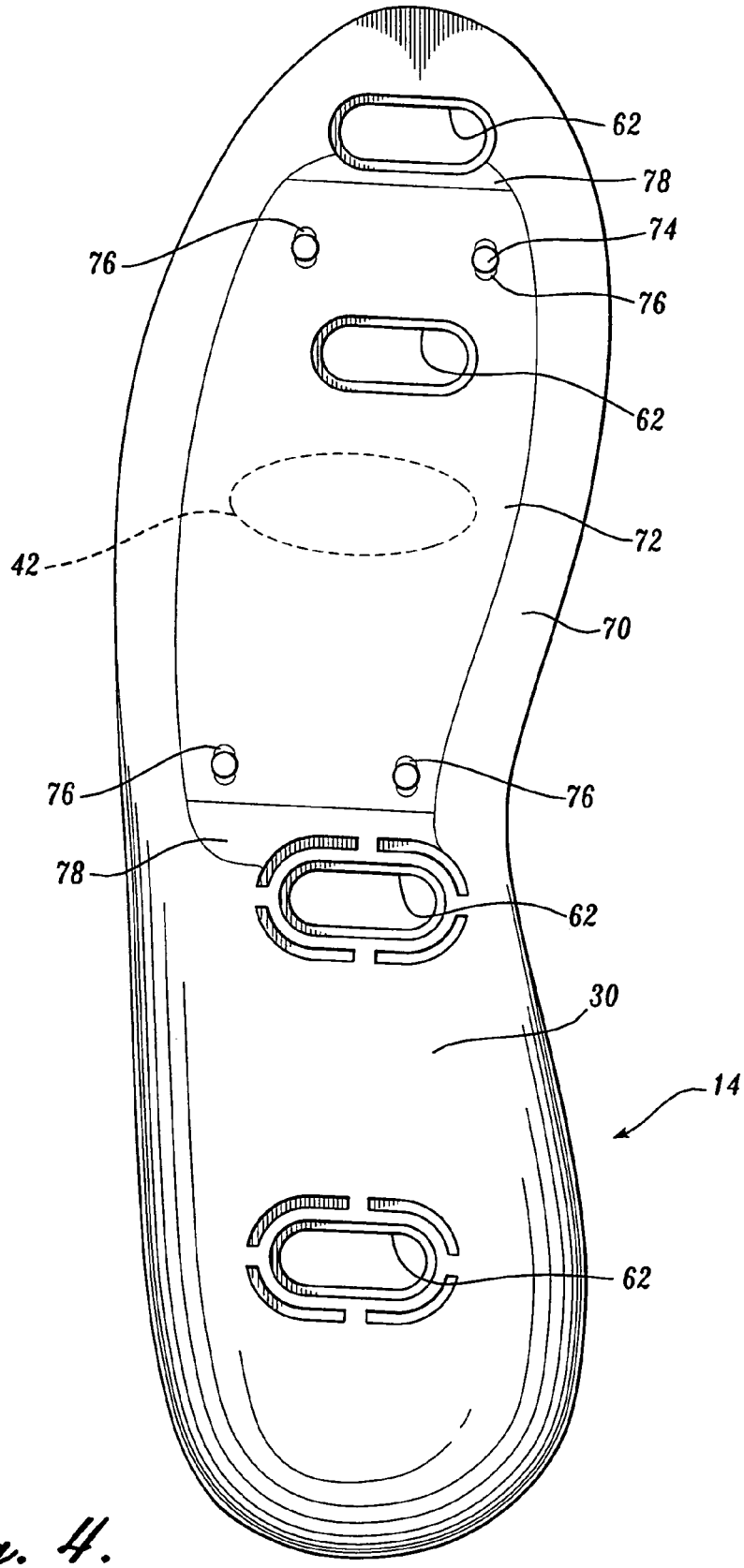
FIG. 4 provides a top plan view of the base of the skate of FIG. 1.

The base 14 is best viewed in FIGS. 1, 3, and 4. The base 14 has an upper surface 30 (FIG. 4) that receives and supports the undersides of the upper shoe portion 12. The base 14 is secured to the upper shoe portion 12 by any conventional method, including bolting, riveting, stitching, and adhesive lasting. While the base 14 is illustrated as separate from the upper shoe portion 12, it should also be understood that the base 14 could be integrally formed with the upper shoe portion 12, so long as the upper shoe portion 12 and base 14 accommodate flexing in the manner to be described further herein. The upper surface 30 of the base 14 is bordered by a raised lip surrounding the perimeter of the base 14. The lip extends upwardly at the rear and forward ends to partially surround the lower edges of the toes and heels of the user.

As best illustrated in FIGS. 1 and 3, the base 14 includes a lower surface 39 that is supported by longitudinally oriented ribs 41 extending along the inner and outer longitudinal sides of the lower surface 39 of the base 14. The ribs 41, formed as increased thickness sections of the base 14, serve to rigidize the heel region 24 and a forward portion of the forefoot region 20 of the base 14. However, the ribs 41 do not extend longitudinally below the metatarsal head portion 22 of the forefoot region 20 of the base. Thus, the effective thickness of the metatarsal portion 22 of the base 14 is reduced relative to the thickness of the surrounding regions of the base 14. This reduced thickness enables the base 14 to flex at the metatarsal head portion 22 and, more specifically, focuses the flexure of the base 14 at the metatarsal head portion 22, in a gradual arc along the length of the metatarsal head portion, as illustrated in FIG. 2.

The ability of the metatarsal head portion 22 to flex is further enhanced by the formation of a transverse, elongate aperture 42 through the metatarsal head portion 22. The aperture 42 extends transversally and centrally across approximately half of the width of the metatarsal head portion 22, and also extends forwardly and rearwardly across the majority of the length of the metatarsal head portion 22. This aperture 42 serves to further concentrate the stress of flexure on the metatarsal head portion 22. Moreover, the aperture 42 is formed with a transverse elongate ovoid configuration, serving to further focus the flexure along the centerline of the metatarsal head portion 22. Thus, as illustrated in FIG. 2, the base 14 and upper shoe portion 12 flex at the anatomically preferred position just below the metatarsal head, following the natural contour of the metatarsal head as it flexes.

Attention is now directed to FIG. 3 to describe the construction of the split frame assembly 16. Each of the forward frame segment 26 and the rearward frame segment 28 has an independent torsion box construction. The forward frame segment 26 has a top wall 31 extending rearwardly from immediately below a forward toe portion of the forefoot region 20 of the base 14, to just forwardly of the metatarsal head portion 22.

The forward frame segment 26 further includes left and right opposing sidewalls 32 that are oriented longitudinally relative to the length of the base 14. The rear frame segment 28 correspondingly includes a top wall 34 and longitudinal left and right sidewalls 36. The top wall 34 runs from beneath an arch portion of the heel region 24 of the base 14, to the rear end of the heel region 24. A weight-reducing aperture 38 is cut out from the center of the top wall 34.

The top walls 31 and 34 of the forward and rearward frame segments 26 and 28 are horizontally oriented, with the sidewalls 32 and 36 projecting perpendicularly downward therefrom. Each frame segment 26, 28 is completed by a series of lower horizontal braces 40 spanning between the left and right sidewalls 32 of the forward frame segment 26 and the left and right sidewalls 36 of the rearward frame segment 28. The lower braces are parallel to and spaced downwardly from the top walls 31 and 34, and are oriented between the wheels 18*a*, 18*b*, 18*c*, and 18*d*.

Specifically, the forward frame segment 26 carries a first forward wheel 18*a* and a second forward wheel 18*b* journaled between the opposing sidewalls 32. Each wheel includes a center hub and bearing assembly 44 that is mounted rotatably on an axle 45 that is inserted through aligned apertures 46 of the sidewalls 32 and are retained by cap screws 48. In the forward segment 26 of the frame, a single horizontal brace 40 is disposed between the first forward wheel 18*a* and the second forward wheel 18*b*. The rearward frame segment 28 similarly carries a first rearward wheel 18*c* and a second rearward wheel 18*d* journaled between its sidewalls 36 on axles 45. A first horizontal brace 40 (not shown) is formed between the sidewalls 36 just forwardly of the first rearward wheel 18*c*, and a second horizontal brace (not shown) is formed between the first and second rearward wheels 18*c* and 18*d*. The top walls, sidewalls, and lower horizontal braces of the forward and rearward segments 26, 28 thus complete for each frame segment a stiff, elongate, box-like structure having good torsional rigidity. The torsional rigidity provided by the horizontal braces 40 (not shown) is desirable, but a frame constructed without crossbracing would also be within the scope of the present invention. Likewise, alternate crossbracing, such as diagonal internal crossbracing or external braces extending down from the base 14, could be utilized. The frame segments 26, 28 can be formed from any suitable rigid material, such as aluminum, titanium, other metals and alloys, engineering thermoplastics, and fiber-reinforced thermoplastics or thermosetting polymers.

Referring still to FIG. 3, the forward frame segment 26 includes left and right stabilizing flanges 50 secured to or integrally formed with the sidewalls 32 to form rearward extensions thereof. The stabilizing flanges 50 extend rearwardly of the innermost, i.e., second forward wheel 18*b*, toward the innermost, i.e., first rearward wheel 18*c*. The stabilizing flanges 50 can be welded (for metal materials), screwed, adhered, or riveted to the sidewalls 32 of the forward frame segment 26. Alternately, the forward frame segment 26 including the stabilizing flanges 50 can be integrally cast, molded or machined. The stabilizing flanges 50 have an internal spacing separating the two flanges such that they closely and slidably receive the forward ends of the sidewalls 36 of the rearward frame segment 28. In the preferred embodiment, the spacing between the stabilizing flanges 50 of the forward frame segment 26 is greater than the spacing between the remainder of the sidewalls 32 of the forward frame segment 26. Thus the sidewalls effectively expand externally, bending first laterally outward and then rearwardly, to define the stabilizing flanges 50.

FIG. 1 illustrates the stabilizing flanges 50 overlapping the forward ends of the sidewalls 36 of the rear frame segment 28. The overlap fit of the stabilizing flanges 50 and sidewalls 36 of the rear frame segment 28 is close, with the width from the outer surface of the left sidewall 36 to the outer surface of the right sidewall 36 being just slightly less than the width between the inner surfaces of the stabilizing flanges 50. This close fit is desirable so that the rearward frame segment 28 is substantially prevented from pivoting laterally, i.e., off longitudinal axis, relative to the forward frame segment 26. Thus, the stabilizing flanges 50 serve to torsionally couple the independent frame segments 26 and 28, particularly where the base 14 is unflexed as illustrated in FIG. 1. The frame segments 26 and 28 are coupled only by this overlap, and by virtue of both being secured to the base 14, and are preferably otherwise independent.

This stabilizing overlap continues at least partially during all stages of flexure of the base 14.

To further increase the torsional rigidity of the frame assembly 16, the stabilizing flanges 50 are reinforced by a transverse stabilizing pin 52 inserted through aligned apertures formed through lower edge portions of the flanges 50. The stabilizing pin 52 is retained in place by a head on one end and a cap screw or a flare formed on the other end. The stabilizing pin 52 prevents the stabilizing flanges 50 from undesirably flaring outward or bending away from each other during use, maintaining them in spaced parallel disposition.

The forward ends of the sidewalls 36 of the rearward frame segment 28 each include a notch-like recess 54 that receives and accommodates the stabilizing pin 52 when the frame segments 26 and 28 are longitudinally aligned in the unflexed configuration, as shown in FIG. 1. This notch 54 allows the stabilizing pin 52 to be set rearwardly as far as possible for maximum transverse stabilization. In the preferred embodiment illustrated in FIG. 3, the rearward ends of the stabilizing flanges 50 taper downwardly in vertical width as they extend rearwardly. Conversely, the forward ends of the sidewalls 36 taper forwardly and upwardly in vertical width as they extend forwardly. This construction allows for maximum overlapping of the stabilizing flanges 50 and sidewalls 36. However, other configurations, including blunt ends on both the stabilizing flanges 50 and sidewalls 36, are possible. Further, rather than including distinct stabilizing flanges 50, as illustrated in FIG. 3, the sidewalls 32 of the forward frame segment 26 could simply have a greater width, or a rearward portion of the sidewalls 32 could be bent to define a greater width, to accommodate the rearward frame segment 28—all within the scope of the present invention.

Further, the stabilizing flanges could alternately be mounted on the rearward frame segment 28 and overlap the forward frame segment 26. Additionally, rather than side flanges, differing longitudinal projection(s) could be included on either the forward or rearward frame segment 26 or 28 to be closely and slidably received within a corresponding slot, recess, or space in the other of the forward or rearward frame segments.

Other than the overlapping of the stabilizing flanges 50, the forward and rearward frame segments 26 and 28 are independent of each other. Thus, the forward and rearward segments 26 and 28 are free to pivot and slide relative to each other during flexure of the base 14, without restriction. To further facilitate this sliding pivotal movement of the forward and rearward frame segments 26 and 28, a low friction surface, such as a Teflon™ fluoride polymer pad 56, is preferably applied to the exterior of the forward ends of each of the sidewalls 36 of the rearward frame segment 28. Alternately, the low friction pads 56 can be applied to the interior of the stabilizing flanges 50, or to both the stabilizing flanges 50 and the rear frame segment 28, although low friction materials, such as nylon pads, or bearings, could also be utilized. Thus, frictional resistance between movement of the forward and rearward frame segments 26 and 28 is minimized. The flexure of the base 14 is limited only by the skater's foot positioning and activity and the biasing of the base 14 (to be discussed below), rather than by the frame assembly 16.

Referring to FIGS. 1 and 3, the frame assembly 16 includes a mechanism for selectively locking the forward frame segment 26 to the rearward frame segment 28, so that the frame assembly 16 becomes rigid along its length. This may be desired, for instance, by beginning skaters who may be more comfortable on a rigid frame. In the preferred embodiment illustrated, a locking pin 58 having a head on one end and spring loaded detent ball on the opposing end, may be inserted if desired through aligned apertures 60 formed in each of the stabilizing flanges 50 and the forward ends of the sidewalls 36 of the rear frame segment 28. When the base 14 is unflexed such that the forward and rearward frame segments are longitudinally aligned, as shown in FIG. 1, the locking pin may be inserted if desired. Removal of the locking pin 58, by pushing of the locking pin 58 with an Allen wrench or other tool from the detent side, restores the skate to the flexing configuration.

Referring again to FIG. 3, each of the forward and rearward frame segments 26 and 28 is mounted to the base 14 for independent lateral and horizontal adjustment. For this purpose, the base 14 includes a spaced series of four transverse mounting slots 62. Each mounting slot 62 is bordered by a downwardly projecting boss. Each mounting slot 62 is reinforced by a corresponding slotted metal plate molded or adhered within the base 14, midway between the upper surface 30 and the lower surface 39. The reinforcing plates may be suitably formed of a metal such as aluminum, and each defines a lip 63 projecting internally about the perimeter of the corresponding slot 62. The head of a stud 64 is received within each slot from the upper surface of the base 14, and rests on the lip 63 defined by the reinforcing plate. Each stud 64 includes an internally threaded stem that extends downwardly through the slot 62 and lip 63. The studs 64 can be slid laterally from side to side along the length of the slots 62.

The top wall 31 of the forward frame segment 26 includes two longitudinally oriented mounting slots 66. The top wall 34 of the rearward frame segment 28 includes two longitudinally oriented mounting slots 66 as well. The longitudinal mounting slots 66 at the forward frame segment 26 are alignable with the two forwardmost transverse mounting slots 62 formed in the base 14. These forwardmost mounting slots 62 are formed within the forefoot region 20 of the base 14, just below the toes and just forwardly of the metatarsal head portion 22. Mounting bolts 68 are inserted from the underside of the forward frame segment 26, through the longitudinal slots 66 into the corresponding studs 64 to mount the forward frame segment 26 to the forefoot region 20 of the base 14. When the bolts 68 are loosely received in the studs 64, the forward frame segment 26 can be slid forwardly and rearwardly along the length of the slot 66, and can also be slid transversely left or right along the length of the slots 62. When the desired forward and rearward location and side to side location, as well as angulation, is achieved, the bolts 68 are tightened into the studs 64 to retain the forward frame segment in this position.

Similarly, mounting bolts 68 are inserted through the longitudinal slots 66 in the rearward frame segment 28, and into the studs 64 retained in the two rearmost transverse slots 62 of the heel region 24 of the base 14. The two rearmost transverse slots 62 are defined immediately below the heel and below the arch of the base 14. The rearward frame segment 28 can be longitudinally, laterally, and angularly adjusted, just as can the forward frame segment 26. The forward and rearward frame segments 26 and 28 can be adjusted independently of each other.

The adjustable mounting of the forward and rearward frame segments 26 and 28 makes possible the lengthening and shortening of the frame assembly 16 of the skate 10. A longer frame may be desired for increased speed, while a shorter frame may be desired for increased maneuverability. Likewise, the left and right positioning of the frame segments may be desired for individual skating styles to facilitate straight tracking or turning.

Referring to FIGS. 1 and 2, the mounting of the forefoot region 20 of the base 14 to the forward frame section 26 provides for a stable platform from which to push off of during the thrust portion of a skating stroke. Specifically, the point of flexure of the base 14, at the metatarsal head portion 22, is disposed either just above or forwardly of the axis of rotation of the innermost forward wheel 18*b* of the forward frame segment 26. The axis of rotation of the innermost forward wheel 18*b* is defined by the corresponding axle 45, and corresponds to the point of contact of the innermost forward wheel 18*b* with the ground. Thus, during flexure of the skate, when the rearward frame segment 28 and rearward wheels 18*c* and 18*d* are lifted off of the ground, a stable platform is still provided because the rearwardmost contact point with the ground provided by the wheel 18*b* is either immediately below or behind the point of flexure at the metatarsal head portion 22. This prevents the forward frame segment 26 from undesirably tipping upward, so that the forwardmost forward wheel 18*a* would rise off the ground during the thrust portion of the stroke.

Referring to FIGS. 2 and 4, the flexing skate 10 of the present invention preferably includes a biasing member to urge the base 14 downwardly to the lower or unflexed configuration of FIG. 1 and away from the upper or flexed configuration of FIG. 2. Preferably, this biasing is provided by a spring incorporated into the base 14 that is coplanar with the base 14. For example, the base 14 can be constructed from a resilient composite material, such as a thermosetting or thermoplastic polymer reinforced by fibers. One suitable example of such a resilient composite material is an epoxy reinforced with plies of carbon fibers, woven at 45°-angles relative to the longitudinal axis of the base 14. This construction results in the transverse metatarsal head portion 22 still retaining torsional stiffness, while also resiliently flexing longitudinally.

An alternate method of incorporating a spring into the base 14 is illustrated in FIG. 4. Specifically, a wide elongate recess 70 is formed in the upper surface 30 of the base 14. The recess 70 extends across a majority of the width of the base 14 and from the forward end of the toe region 20 of the base 14, just behind the forwardmost mounting slot 62, to approximately midway along the length of the base 14, just forwardly of the third mounting slot 62. This recess 70 receives a spring plate 72, which spans the width and most of the length of the recess. The spring plate 72 passes over and is centered on the metatarsal head portion 22. The spring plate 72 may be suitably formed as a strip of spring steel, or alternately may be a strip of other resilient material, such as a reinforced composite. The spring plate 72 is suitably adhered in place or may be retained by rivets. In the preferred embodiment, the spring plate is adhered between the base 14 and the upper shoe portion 12 on both the upper and lower surfaces during the lasting process. Additionally, four rivets 74 are inserted through the base 14 and each corner of the spring plate 72 through corresponding short longitudinal slots 76 formed in the spring plate 72. This allows some longitudinal shifting of the spring plate 72 relative to the base 14 during flexure of the base 14. The recess 70 may also include two transverse elastomeric strips 78 positioned forwardly and rearwardly of, and abutting, the forward and rearward ends of the spring plate 72. These elastomeric strips 78 compress and absorb the longitudinal movement of the spring 72, as permitted by the slots 76, during flexure of the base 14. Upon return of the base 14 to the unflexed configuration, the elastomeric strips 78 decompress, thereby further urging the spring 72 to its original configuration with additional force.

Referring to FIGS. 1 and 2, the spring plate 72 acts to urge the heel region 24 of the skate 10 downwardly to the unflexed configuration of FIG. 1. Moreover, the spring plate 72 is preferably preloaded such that it biases the heel region 24 of the base 14 downward sufficiently to introduce a negative camber to the longitudinal orientation of the wheels 18*a*, 18*b*, 18*c*, and 18*d*. Specifically, FIG. 1 illustrates a planar ground surface 96 across which a skater may traverse. Before the weight of the skater's body is introduced to the base 14, the skate 10 is biased by the spring plate 72 such that the intermediate wheels 18*b* and 18*c* are elevated slightly relative to the forwardmost wheel 18*a* and rearwardmost wheel 18*d*. Thus, the bottom surfaces of the wheels define a plane arcing slightly downwardly, as illustrated by line 98 in FIG. 1. As soon as the user's weight is applied to the base 14, the intermediate wheels 18*b* and 18*c* move downwardly as the preload of the spring plate 72 is overcome, until all wheels reside on the ground in an even planar configuration. The preloading of the spring plate 72 in this manner eliminates rockering of the skate 10, and may be utilized when an antirockering skate is desired. During each stroke as the skate begins to touch the ground, the intermediate wheels 18*b* and 18*c* will not initially contact the ground, eliminating undesired tracking during that portion of the stroke. The initial cambering of the wheels 18 ensures that proper contact of the forward and rearward wheels with the ground remains at all times.

While the preferred embodiment in FIG. 1 has been illustrated with four wheels, a differing number of wheels, more or less, could be utilized. For instance, a greater number of wheels, such as five wheels, may be desired for greater speed.

During skating on the flexing skate 10, the base 14 flexes about a laterally extending axis defined transverse to the longitudinal axis of the split frame assembly 16. However, the reduced thickness stress concentrating contour of the metatarsal head portion 22 may be oriented alternately, such as with a slight angle relative to the longitudinal axis of the frame assembly 16. This would thereby define a slightly angled transverse rotational axis that still more closely follows the contour of the metatarsal head of the skater's foot. The center of rotation of the base 14 and skate 10 is at a plane immediately below the metatarsal head of the skater's foot, and is preferred because centering rotation at other locations may cause the skater's foot to cramp. During skating, as the skater enters the push-off phase of the skating stroke, the skater utilizing the flexing skate 10 of the present invention may plantarflex his or her ankle, while flexing his or her foot above the metatarsal head portion 22 of the base 14. The forward frame segment 26 remains firmly on the ground as the rearward frame segment 28 elevates off the ground. The weight of the skater's foot pivots off the metatarsal head of the foot, and the weight of the skater bears down on the forward frame segment 26. A stable platform is provided by the two forwardmost wheels 18*a*, 18*b*, from which the skater is able to propel himself or herself forward. This skating action is more fully described in copending application Ser. No. 08/957,436, the disclosure of which is hereby expressly incorporated by reference.

During this push off or thrusting portion of the stroke, as the heel is lifted and the foot flexes, the spring plate 72 permits thrusting off of the forward end of the skate with greater power. The spring plate 72 bends at the metatarsal head portion 22 of the skate and the skate front loads the metatarsal head forward onto the remainder of the forefoot region 20 of the base 14. As soon as the stroke is completed and the user releases the tension from his or her foot, the spring 72 causes the heel region 24 of the base 14 to rebound to the unflexed configuration of FIG. 1, with energy being returned to the skate for a continued forward stride. Moreover, the preloading of the spring plate 72 causes the skate 10 to snap down firmly and positively into the aligned, unflexed configuration.

Utilization of the flexing base 14 of the skate 10 provides for greater control, particularly during longer strokes. The skate remains firmly under the weight of the user during the full length of a stroke, and the user is better able to maintain his or her center of gravity in a straight line. Thus longer strokes and greater speed are provided by use of the flexing skate 10 relative to a conventional rigid frame skate. Moreover, the split frame assembly 16 and flexing base 14 of the present invention provide the skater the ability to jump off of the forward frame segment 26, utilizing the spring action of his or her legs and feet as the foot is flexed during upward jumping movement, and rebounding after weight is removed from the skate to the unflexed configuration. Thus, jumping in the skate 10 of the present invention is possible even without the utilization of a ramp or other elevating device. The user instead simply springs off of the forward frame segment 26.

An additional benefit of the split frame configuration 16 and flexing base 14 is that the skate 10 thereby provides an integral suspension system. As the skate 10 passes over bumps and protrusions in the ground during skating, either of the forward frame segment 26 or rearward frame segment 28 can lift relative to the other, with the base 14 flexing as required accordingly, to dampen shock and impact to the skater's foot. Thus greater control and higher speeds are possible. The heel of the skater's foot is able to move up and down freely of the toe of the skater's foot. Full arcuate flexing of the foot is provided by the skate of the present invention, for enhanced maneuverability, speed, and jumping abilities.

Figure 5:
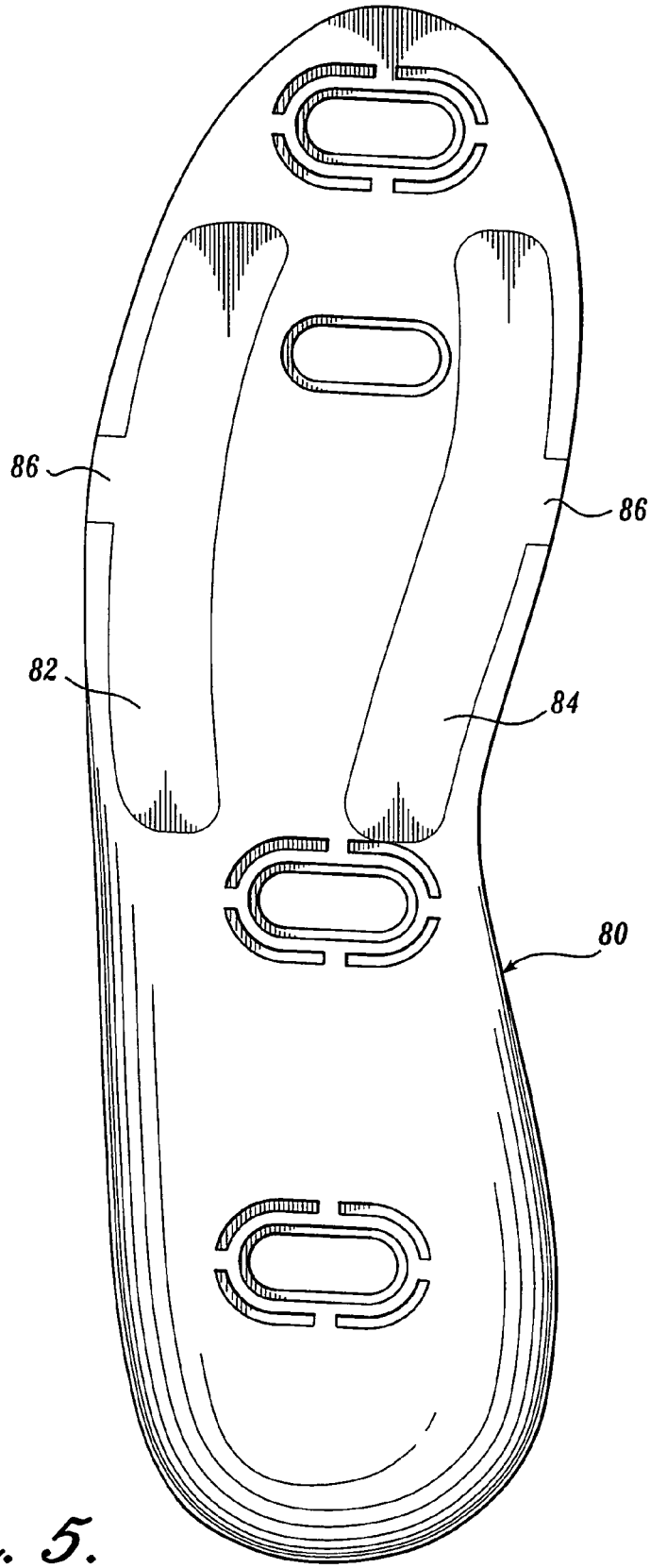
FIG. 5 provides a top plan view of an alternate embodiment of the base suitable for incorporation into the skate of FIG. 1, with interchangeable spring elements.

FIG. 5 provides a variation on the base 14 of the skate of FIG. 1. FIG. 5 illustrates an alternate base 80 that is configured the same as the base 14 previously described in most respects. However, rather than a single longitudinal recess 70 and spring plate 72, left and right narrow elongate spring strips 82 and 84 are mounted within corresponding elongate recesses along the left and right edges of the skate, again in the forefoot region 20 of the skate, and centered over the metatarsal head portion 22. The narrow spring strips 82 and 84 are inserted laterally into the base 80 through slots defined in the perimeter of the base 80. To this end, each of the spring strips 82 and 84 may include a tab 86 that is manually grasped, or grasped with pliers, for removal and installation of the spring strips 82 and 84. Once installed, the spring strips 82 and 84 are closely received within the recesses, and the preloading of the springs 82 and 84 retains them in this position. This construction enables the spring strips 82 and 84 to be removed and interchanged with differing spring strips having a higher or lower spring constant for more or less biasing force, as may be desired for particular users or applications. Other forms of interchangeable or adjustable biasing elements may be utilized, such as piezoelectric transducers, and are all within the scope of the present invention. Piezoelectric transducers would serve the functions of dampening vibration and controlling the amount of flexure and the amount of return flex or camber preload in response to varying surface conditions, providing a responsive suspension system.

Figure 6:
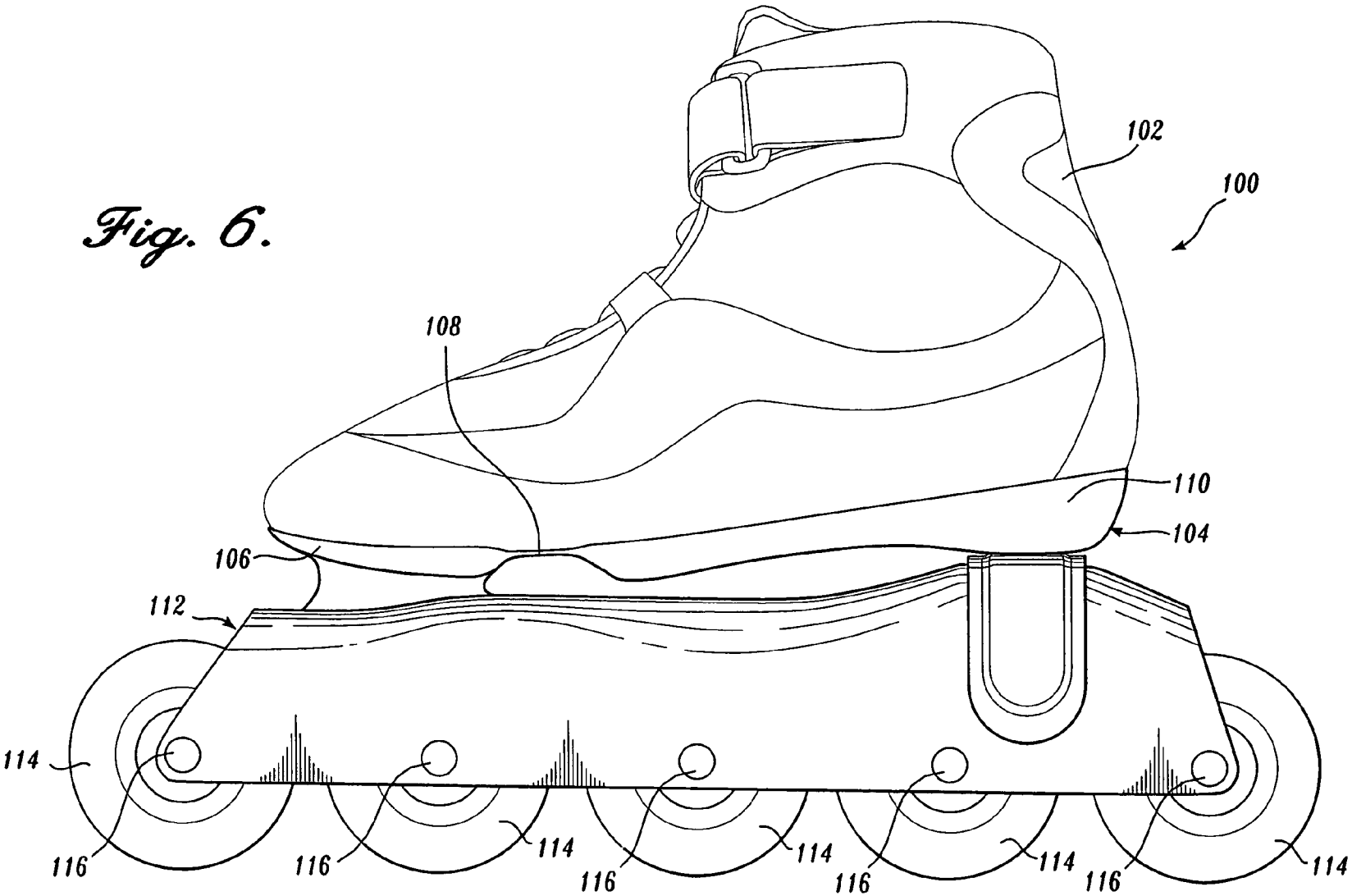
FIG. 6 provides a side view of a skate constructed in accordance with a second embodiment of the present invention, having a rigid frame and flexing base, with the heel end of the base being free of the frame, shown in the unflexed configuration.
Figure 7:
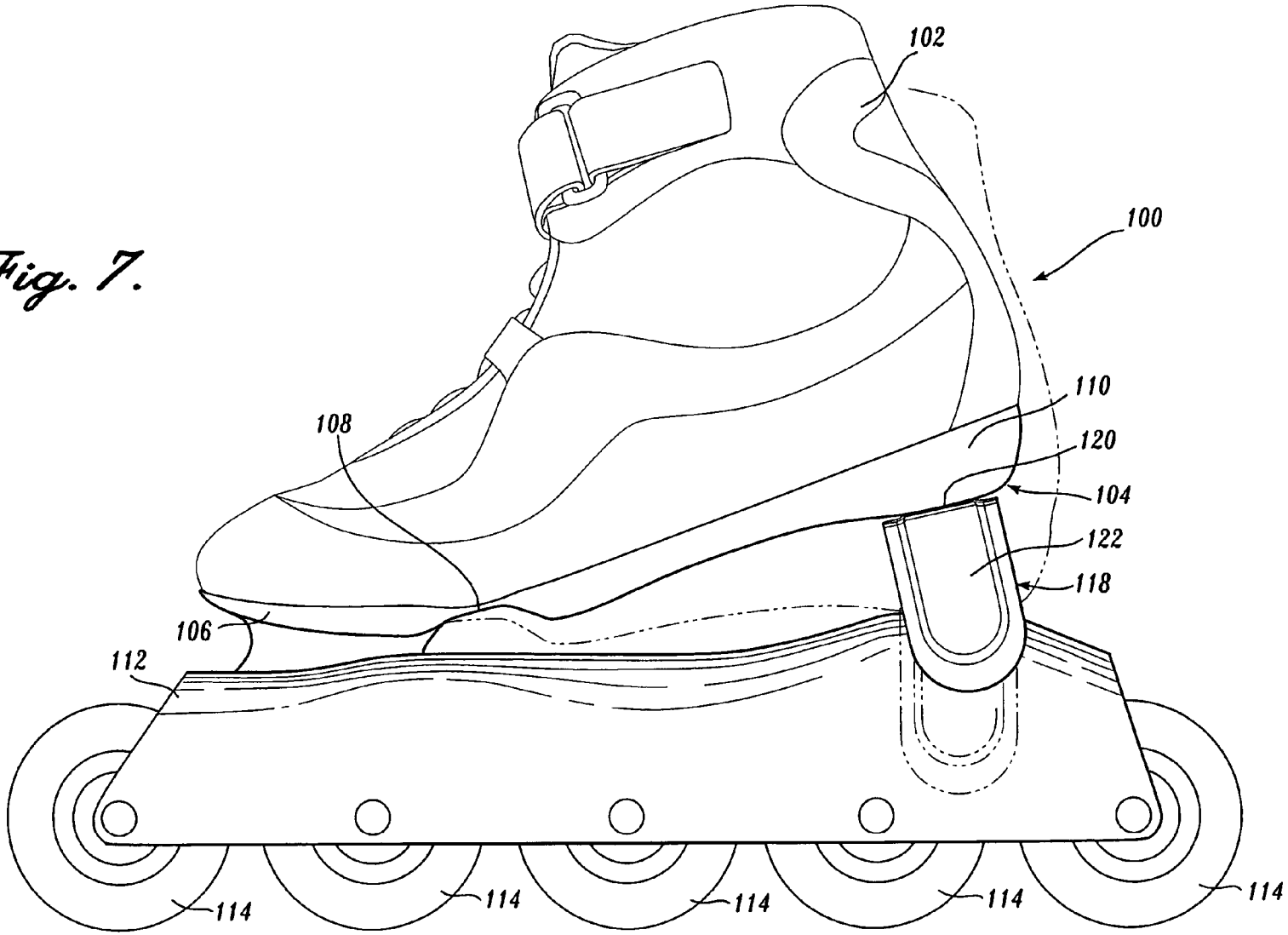
FIG. 7 provides a side view of the skate of FIG. 6 in the flexed configuration.

An alternate embodiment of a flexing base skate 100 is illustrated in FIGS. 6 and 7. The skate 100 again includes an upper 102 secured along its underside to a base 104. The upper 102 and the base 104 are constructed substantially similar to the upper 12 and base 14 of the previously described embodiment of the skate 10. In the skate illustrated in FIGS. 6 and 7, the upper 102 is configured as a racing skate boot; however other configurations of skate boots, such as that illustrated in FIG. 1, may alternately be utilized. The base 104 is constructed similarly to the base 14 illustrated in FIG. 1, and includes a forefoot region 106 having a metatarsal head portion 108 and a heel region 110. The base 104 incorporates a spring, which may suitably be the same as the previously described spring plate 72 illustrated in regard to the embodiment of FIGS. 1 through 4. Alternately, a differing spring construction, such as the use of a resilient composite material, is suitable for use in the embodiment of FIG. 6 to form the base 104 and integral spring.

FIG. 6 illustrates such a composite base and spring, suitably constructed from a composite with fibers oriented at 45° relative to the longitudinal axis of the skate. Thus, the base 104 is of one piece construction, with the contour of the base 104 at the metatarsal head portion 108 providing for flexure of the base below the metatarsal head of the foot, and the composite material utilized to form the base 104 providing the spring force for biasing of the base 104 to the unflexed configuration shown in FIG. 6. The base 104 is also preferably longitudinally reinforced so that it is rigid in front of and rearwardly of the flexible metatarsal head portion 108. Longitudinal reinforcement may be had through the incorporation of ribs, as in the previously described embodiment. Alternately, syntactic foam reinforcing strips or other reinforcing members may be incorporated into the structure of the base 104 rearwardly and forwardly of the metatarsal head portion 108.

Skate 100 also includes a rigid longitudinal frame 112. Unlike the previously described embodiment, the frame 112 has a one-piece construction and extends the full length of the skate. The frame 112 may suitably be formed from a composite material having a downwardly opening, U-shaped, elongate channel configuration to define opposing left and right sidewalls. Alternate frame constructions, such as a torsion box construction such as that previously described, but extending in one piece along the length of the skate, may be utilized. The skate 100 further includes a plurality of wheels 114 journaled on axles 116 between the opposing sidewalls of the frame.

The forefoot region 106 of the base 104 is secured to the forward end of the frame 112. The securement may be by two bolts (not shown) that are longitudinally spaced, that pass through apertures defined in the upper wall of the frame 112, and that are received within threaded inserts molded into or captured above the upper surface of the base 104. Alternate constructions, such as studs that extend downwardly from the base 104 and that receive nuts received within the frame 112, or riveting, may be utilized. The base 104 is fixedly secured to the frame 112 only at the forefoot region 106. The base 104 is not secured and is free of the frame 112 at the metatarsal head portion 108 and rearwardly behind the metatarsal head portion 108, including the heel region 110. Thus, the heel region 110 of the base 104 may be elevated or lifted above and away from the frame 112, with the base 104 flexing at the metatarsal head portion 108, as shown in the flexed configuration of FIG. 7. Just as in the previously described embodiment, the user may flex his or her foot to lift his or her heel during the skating stroke. However, the full length of the frame 112 remains parallel to the ground, with all of the wheels 114 contacting and rolling on the ground.

Although the heel region 110 of the base is able to elevate from the frame 112 during skating, it is still desired to maintain the heel region 110 centered above the base 112 and to avoid torsional twisting of the base 104 that would result in the heel region 110 being displaced laterally to either side of the frame 112. Torsional rigidity is provided to the base 104 in part by the selection of materials utilized to construct the base 104. Thus, in the preferred embodiment utilizing a composite material, the reinforcing fibers provide a high degree of torsional rigidity while permitting flexing at the metatarsal head portion 108. Further lateral stability and alignment of the base 104 relative to the frame 112 are provided by a guide member 118 secured to the lower surface of the base 104, immediately below the rear end of the heel region 110.

The guide member 118 of the preferred embodiment illustrated has an elongate, U-shaped configuration, including a center top portion 120 that is bolted, riveted, or otherwise secured to the base 104. The guide 118 further includes first and second side flanges 122 that depend perpendicularly downwardly from the top portion 120, on either side of the frame 112. The frame 112 is slidably and closely received between the left and right side flanges 122. The guide 118 is preferably constructed with a high degree of rigidity. The guide 118 may suitably be constructed from a laminate of syntactic foam surrounded and encapsulated within inner and outer layers of reinforced composite material. Other materials, such as aluminum, may alternately be utilized. Preferably, a low friction surface is formed on either the frame 112 sidewalls or the interior of the guide 118, so that the two members slide easily relative to each other.

During flexure of the skate between the lower, unflexed configuration of FIG. 6 and the upper, flexed configuration of FIG. 7, the frame 112 remains fully or partially between the opposing side flanges 122 of the guide 118. The heel region 110 of the base 104 thus remains centered over the frame 112 with a high degree of lateral stability. The ability to lift the heel of this flexing base skate 100 provides an unencumbered movement of the heel due to the low weight carried by the heel. The spring incorporated into the base 104 provides the same benefits as in the previously described embodiment, serving to bias the base 104 downwardly to the lower position of FIG. 6. The spring incorporated into the base 104 is preferably preloaded such that the base 104 is biased positively against the frame 112. The advantages provided by flexing the base 104 and skate upper 102 at the metatarsal head portion are also provided by this embodiment of the present invention. However, in the embodiment of FIGS. 6-7, all wheels maintain contact with the ground until the very end of the skating stroke, for added power and stability and that tracks well for fitness and racing applications.

Figure 8:
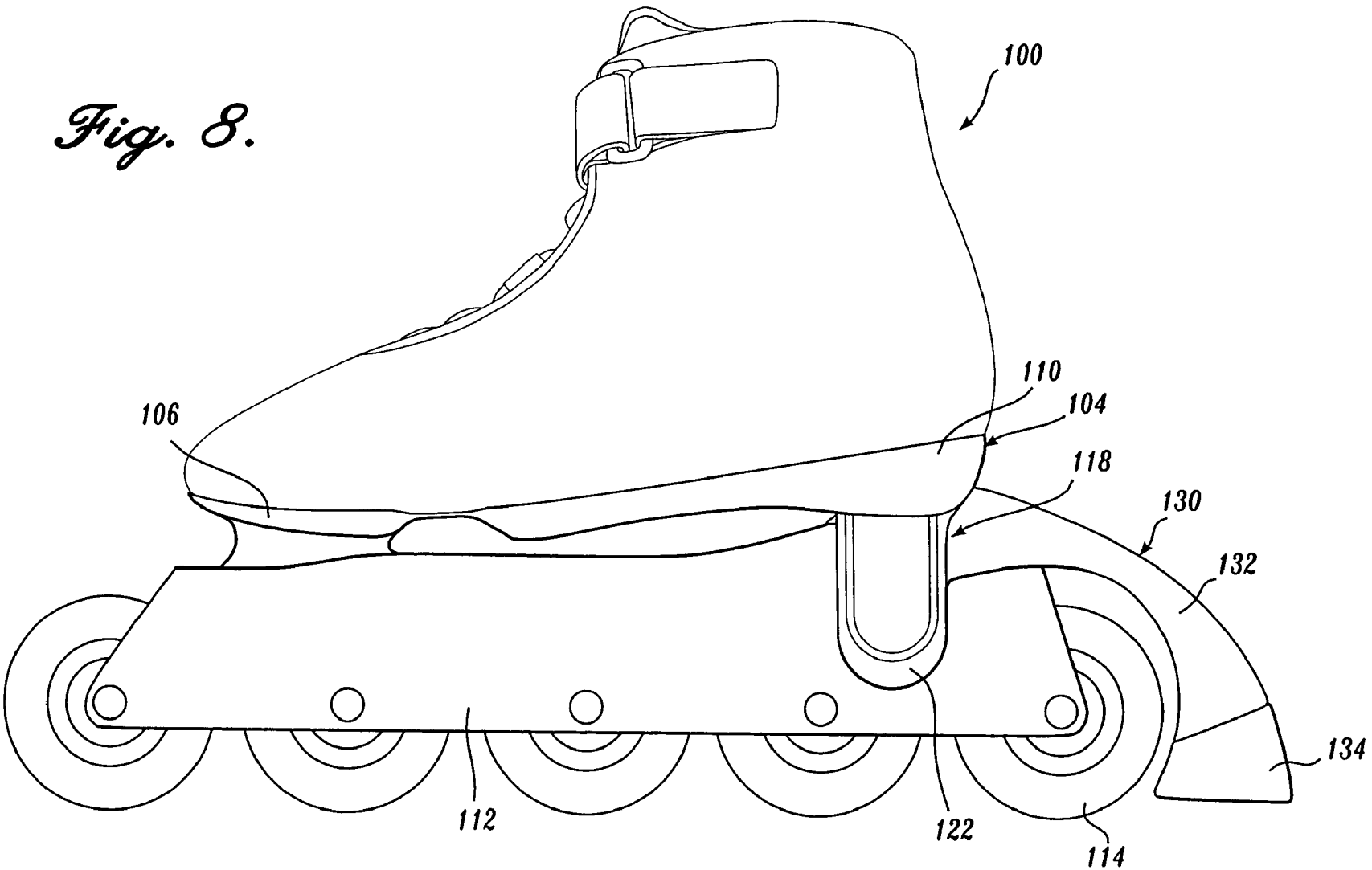
FIG. 8 provides a side view of alternate configuration of the skate of FIG. 6 including a brake element mounted on the base of the skate, in the unflexed configuration.

FIG. 8 illustrates the flexing base skate 100 that is provided with a brake assembly 130. The brake assembly 130 includes a brake arm 132 having an upper end secured to the heel region 110 of the base 104, and that extends rearwardly and downwardly therefrom, terminating rearwardly of the rearmost wheel 114. An elastomeric brake pad 134 is mounted, such as by a screw, to the rear end of the brake arm 132.

Figure 9:
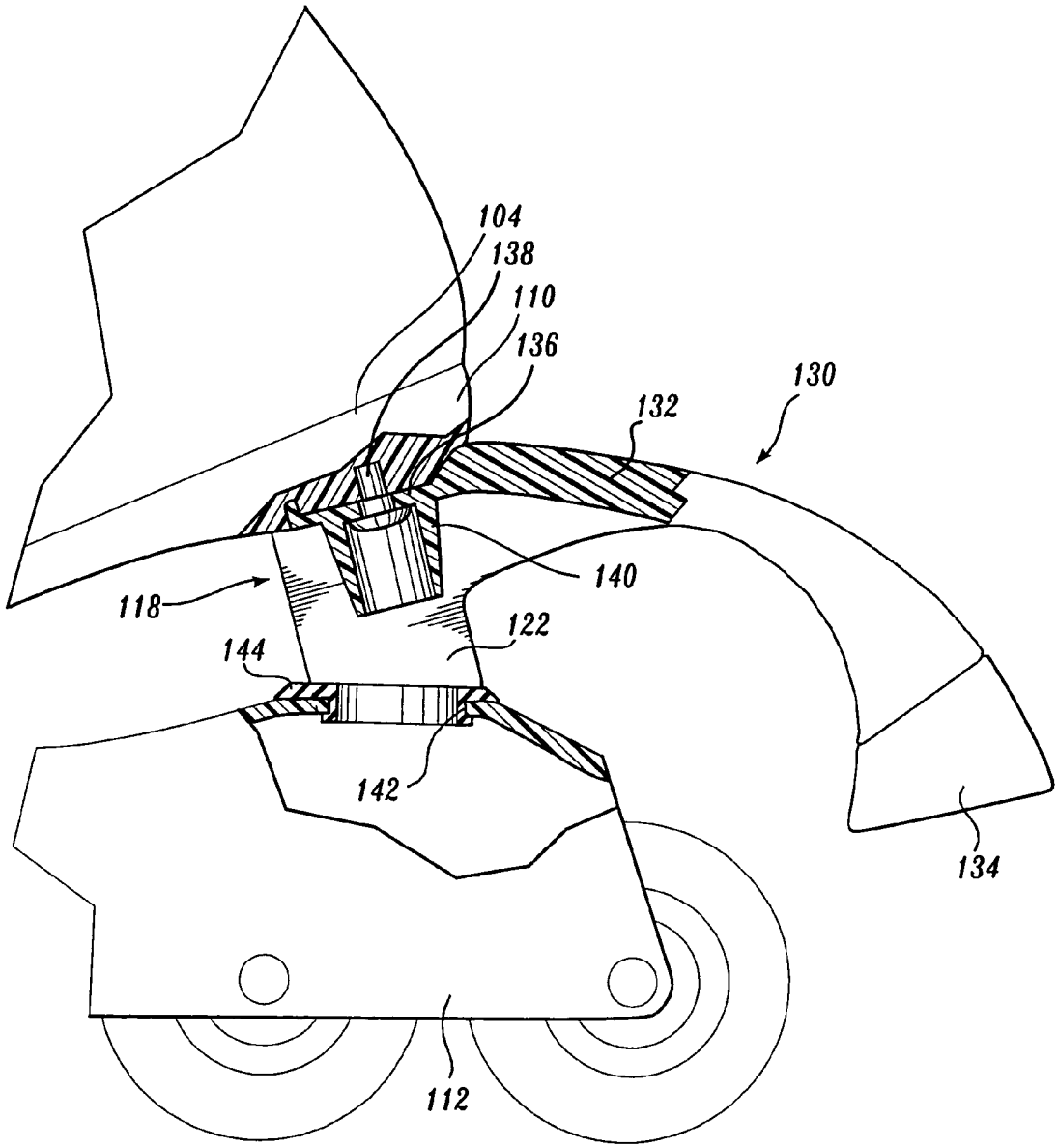
FIG. 9 provides a detailed, partial cross-sectional side elevation view of the skate of FIG. 8 in the flexed configuration, with the guide member shown in phantom.

The construction and mounting of the brake arm 132 is illustrated in FIG. 9. The brake arm 132 has a flattened upper portion 136 that is secured by a bolt 138 to the heel region 110 of the base 104. The guide 118 is integrally formed with the brake arm 132. Thus the upper portion 136 of the brake arm 132 serves as the top surface 120 of the guide element 118. The side flanges 122 of the guide 118 depend downwardly from the upper surface 136 on either side of the frame 112. To further guide the alignment of the base 104 relative to the frame 112 during the initial stages of flexure, the brake arm 132 also includes a tapered cylindrical guide boss 140 projecting centrally downward from the top surface 136. The guide boss 140 does not extend downwardly as far as the side flanges 122. The guide boss 140 is slidably received within a slotted aperture 142 defined in the upper wall of the frame 112. Thus, when the skate is in the unflexed configuration of FIG. 8, the guide boss 140 is received within the slotted aperture 142, and further laterally fixes the base 104 relative to the frame 112. In this configuration, as shown in FIG. 8, the brake pad 134 is adjacent the ground. By rocking back on the rearwardmost wheel 114, the user can bring the pad 134 into engagement with the ground for braking action. During flexing of the skate 100, the brake assembly 130 travels upwardly with the heel of the skate. This construction avoids the excessive lever arm effect that may alternately result if the brake assembly were instead mounted to the frame 112.

It should be readily apparent that the centered guide boss 140 could also be incorporated into the guide 118 of FIGS. 6 and 7, whether or not the brake arm 132 is incorporated.

The free heel flexing skate of FIGS. 6 through 9 provides a shock absorption system similarly to the first preferred embodiment described previously. Thus, the heel of the skate can pivot upwardly off of the frame 112 upon passing over protuberances in the ground. The biasing of the spring incorporated into the base 104, however, prevents undesirable chattering of the base 104 relative to the frame 112. Further shock absorption may be provided by an elastomeric dampening element mounted between the base 104 and the frame 112. Thus, FIG. 9 illustrates an elastomeric grommet 144 that is fitted about the perimeter of the slotted aperture 142, including an upper lip that projects above the frame 112. When the base 104 is pivoted downwardly to the lower position, it contacts the elastomeric grommet 144, which serves to cushion the two members and dampen vibrations and shock therebetween.

It should be readily apparent to those of ordinary skill in the art that alterations could be made to the above-described embodiment. For instance, an elastomeric member could be mounted to other locations of the frame or on the base 104. Further, the guide member could be mounted on the frame to extend downwardly on either side of the base, rather than the guide member projecting downwardly on either side of the frame. Also, a guide member could alternately project upwardly from the frame and engage an aperture defined in a rearward extension of the base.

A third embodiment of a flexing base skate 210 constructed in accordance with the present invention is illustrated in FIGS. 10 through 13. The skate 210 includes an upper shoe portion 212 that is mounted on and secured to a base 214 that is flexible below the metatarsal head of the skater's foot. The base 214 is secured to a split frame assembly 216 that extends longitudinally beneath the base 214 and rotatably connects to a plurality of wheels 218A, 218B, 218C, 218D between first and second opposing longitudinal sidewalls. The base 214 includes a forefoot region 220 having a metatarsal head portion 222 that underlies the metatarsal head of a skater's foot, and a heel region 224 underlying the skater's heel. The frame assembly 216 includes a forward frame segment 226 secured to the forefoot region 220 of the base 214, and a rearward frame segment 228 that is secured to the heel region 224 of the base 214.

The forward frame segment 226, rearward frame segment 228, and flexible base 214 cooperate to permit the skater's foot and the upper shoe portion 212 to flex at a metatarsal portion 222 of the base 214 during the skating stroke. The base 214 and upper shoe portion 212 flex from a lower position, illustrated in FIG. 10, in which the wheels 218A, 218B, 218C, 218D are linearly aligned, and a flexed, upper position illustrated in FIG. 11, in which the heel region 224 of the base 214 and rearward frame segment 228 pivot upwardly relative to the forefoot region 220 of the base 214 and forward frame segment 226. Each of the components of the skate 210 will now be described in greater detail.

Figure 10:
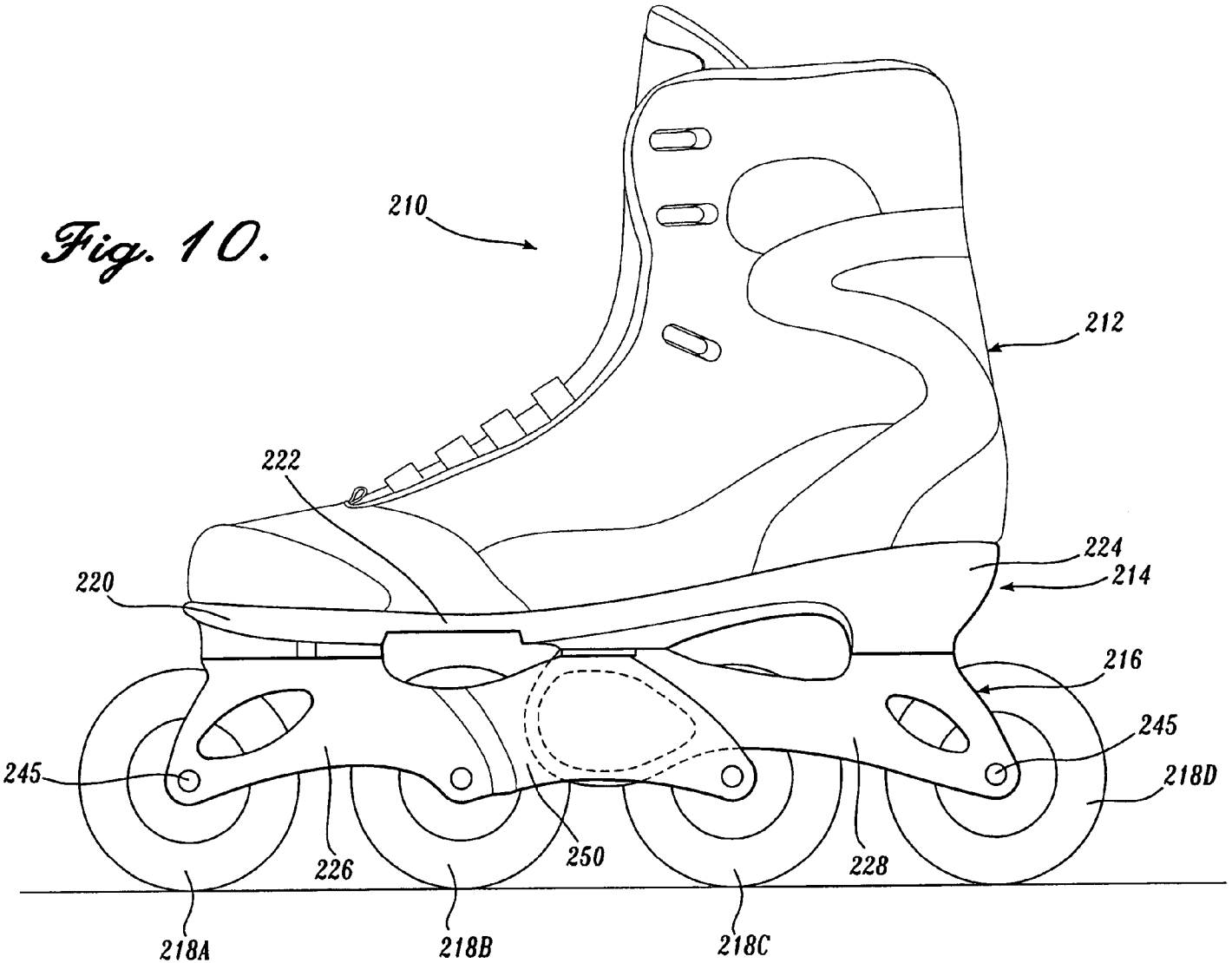
FIG. 10 provides a side view of a skate constructed in accordance with a third embodiment of the present invention shown in an unflexed configuration.
Figure 11:
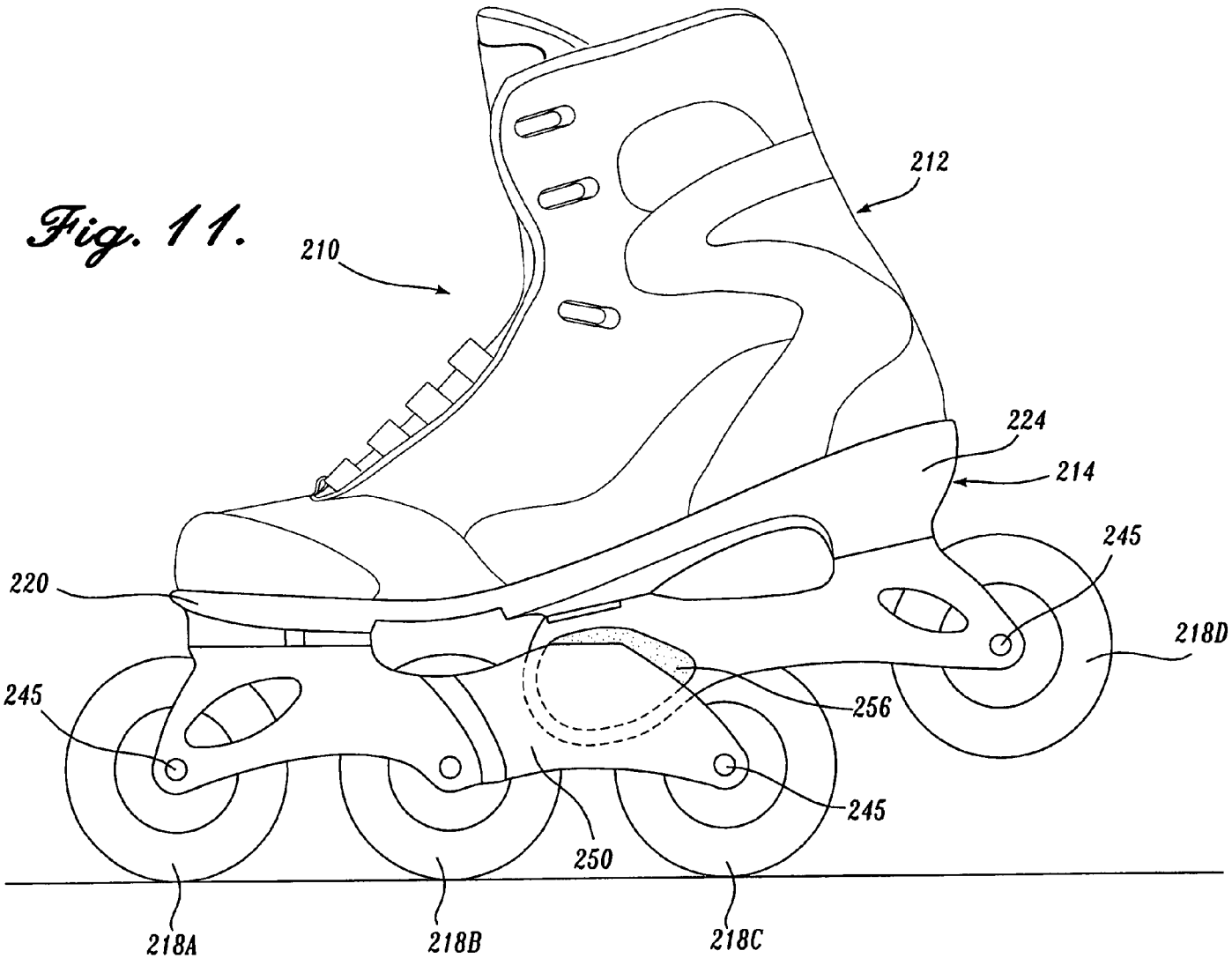
FIG. 11 provides a side view of the skate of FIG. 10, with the skate in the flexed configuration.

Referring to FIGS. 10 and 11, the upper shoe portion 212 surrounds the toes, sides, heels, and ankle of a skater's foot and is constructed at least partially from flexible materials so that the upper shoe portion 212 will flex together with the base 214. The base 214 is best viewed in FIGS. 10 and 12. The base 214 is secured to the upper shoe portion 212 by any conventional method and may optionally include rigidizing ribs (not shown) similar to the ribs 41 described above. The flexibility of the metatarsal head portion 222 of the base 214 is enhanced by the formation of a transverse, elongate aperture 242 (shown in FIG. 12) that extends transversally and centrally across approximately half of the width of the metatarsal head portion 222, in exactly the same manner as the elongate aperture 42 described with respect to the first embodiment shown in FIG. 1. Thus, the base 214 and upper shoe portion 212 flex at the anatomically preferred position just below the metatarsal head or the skater's foot, following the natural contour of the metatarsal head as it flexes.

Figure 12:
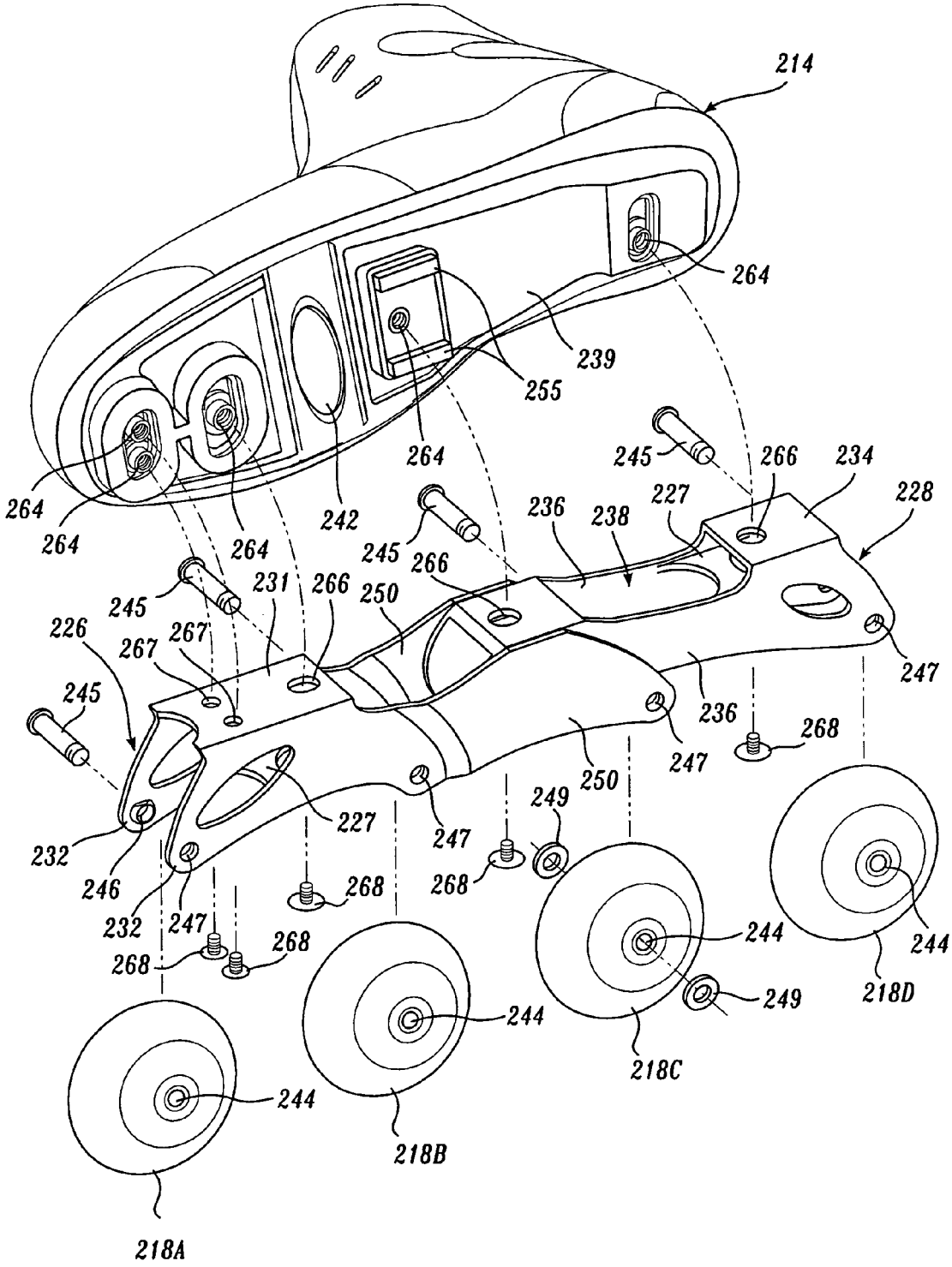
FIG. 12 provides an exploded pictorial view of the skate of FIG. 10.

Attention is now directed to FIGS. 12 and 13 to describe the construction of the split frame assembly 216. The forward frame segment 226 and the rearward frame segment 228 have independent torsion box construction. The forward frame segment 226 has a top wall 231, left and right opposing sidewalls 232, and a pair of vertically separated horizontal braces 227 that are disposed between the two forward wheels 218A and 218B. The rear frame segment 228 correspondingly includes a top wall 234, left and right sidewalls 236, a forward horizontal brace 227 disposed between the middle wheels 218B and 218C, and a pair of vertically separated horizontal braces 227 disposed between the rearward wheels 218C and 218D. The top wall 234 runs from beneath an arch portion 239 of the heel region 224 of the base 214, to the rear end of the heel region 224. A weight-reducing aperture 238 is cut out from the center of the top wall 234. The top walls 231 and 234 of the forward and rearward frame segments 226 and 228 are horizontally oriented, with the sidewalls 232 and 236 projecting perpendicularly downward therefrom. The top walls, sidewalls, and lower horizontal braces of the forward and rearward segments 226, 228 thus complete for each frame segment a stiff, elongate, box-like structure having good torsional rigidity.

The forward frame segment 226 includes rearwardly extending left and right stabilizing flanges 250 secured to or integrally formed with the sidewalls 232. The stabilizing flanges 250 are disposed parallel to each other and spaced apart such that the two flanges 250 closely and slidably receive the forward ends of the sidewalls 236 of the rearward frame segment 228. The spacing between the stabilizing flanges 250 of the forward frame segment 226 is preferably greater than the spacing between the remainder of the sidewalls 232 of the forward frame segment 226.

As best seen in FIGS. 12 and 13, the stabilizing flanges 250 overlap the forward ends of the sidewalls 236 of the rear frame segment 228. The overlap fit of the stabilizing flanges 250 and sidewalls 236 of the rear frame segment 228 is close, with the rear frame width measured from the outer surface of the left sidewall 236 to the outer surface of the right sidewall 236 being just slightly less than the forward frame gap width measured between the inner surfaces of the stabilizing flanges 250. This close fit is desirable so that the rearward frame segment 228 is substantially prevented from pivoting laterally, i.e., off longitudinal axis, relative to the forward frame segment 226. Thus, the stabilizing flanges 250 serve to torsionally couple the frame segments 226 and 228. The frame segments 226 and 228 are coupled only by this overlap, and by virtue of both being secured to the base 214, and are preferably otherwise independent. This stabilizing verlap continues at least partially during all stages of flexure of the base 214. While the referred embodiment illustrated in FIG. 12 shows the forward frame segment 226 overlapping the rearward frame segment 228, it should be apparent based on the disclosure herein that the frame segments could equivalently be configured such that the rearward frame segment overlap the forward frame segment.

In this third embodiment the forward frame segment 226 carries a first forward wheel 218A and a second forward wheel 218B journaled between the opposing sidewalls 232, and a third forward wheel 218C journaled between the opposing stabilizing flanges 250 of the sidewalls 232. Each wheel includes a center hub and bearing assembly 244 that are mounted rotatably on an axle 245. Each axle 245 is inserted through an aperture 246 on one of the sidewalls 232, and threadably engages an aligned and threaded aperture 247 on the opposite sidewall 232. The stabilizing flanges 250, which overlap the rear frame segment 228 as discussed above, are spaced further apart than the sidewalls 236. In the preferred embodiment, annular axle spacers 249 having a thickness approximately equal to the thickness of the sidewalls 236 are provided on either side of the third forward wheel 218C, between the hub and bearing assembly 244 and the stabilizing flanges 250. It will be apparent to one of skill in the art that other options for providing the correct wheel spacing are also possible—for example, the stabilizing flanges could be offset inwardly near the back end, or the hub and bearing 244 of the third wheel 218C could be modified to provide the desired spacing. Further, while three wheels are preferably mounted in the forward frame segment 226, alternatively only two forward wheels could be utilized, within the scope of the present invention.

The rearward frame segment 228 carries a rearward wheel 218D journaled between its sidewalls 236. The rearward wheel 218D is similarly provided with a hub and bearing assembly 244 that is rotatably mounted on an axle 245. While the preferred embodiment illustrated mounts only a single wheel on the rearward frame segment 228, alternatively, two wheels could be utilized.

It will be appreciated that this third embodiment allows the skater's foot to flex in a natural location near the metatarsal region of the foot, while simultaneously providing a relatively stable platform for the skater wherein the three forward wheels 218A, 218B, 218C, maintain contact with the skating surface. Moreover, comparing FIG. 11 with FIG. 2, it will be appreciated that a longer overlap length is provided between the stabilizing flanges 250 and the rear frame segment 228, which advantageously increases the longitudinal stability between the frame segments 226, 228. Finally, it is also noted that the stabilizing pin 52 in the first embodiment, shown most clearly in FIG. 3, is not necessary in this third embodiment because the third wheel 218C and axle 245 will maintain the desired spacing in the stabilizing flanges 250. The rearmost axle 245 on the forward frame segment 226, at the rearward end of the stabilizing flanges 250, ties the stabilizing flanges 250 together laterally to prevent distortion of the flanges 250 out of a parallel disposition along their full length. The rearmost axle 245 of the forward frame segment 226 is disposed rearwardly of the forwardmost point of connection of the rearward frame segment 228 to the base 214 for stability.

The forward and rearward frame segments 226 and 228 are independent of each other, except for the stabilizing flanges 250 overlapping the rearward frame segment 228, and the interconnection through the base 214. Thus, the forward and rearward segments 226 and 228 are free to pivot and slide relative to each other during flexure of the base 214 along the longitudinal axis. To further facilitate this sliding pivotal movement of the forward and rearward frame segments 226 and 228, a low-friction surface, such as a Teflon™ fluoride polymer pad 256, is preferably applied to the exterior of the forward ends of each of the sidewalls 236 of the rearward frame segment 228. Alternately, the low friction pads 256 can be applied to the interior of the stabilizing flanges 250 or to both the stabilizing flanges 250 and the rear frame segment 228.

Referring again to FIG. 12, each of the forward and rearward frame segments 226 and 228 is mounted to the base 214, utilizing a plurality of mounting bolts 268 that threadably engage nut studs 264 in the base 214, similar to the attaching means described above for the first embodiment 10. In this third embodiment of the skate 210, the forward end of the forward frame segment 226 attaches to the base 214 with two mounting bolts 268. When the skater executes a thrusting stroke, the stress is primarily transmitted through the forefoot region 220 of the base 214 to the forward frame segment 226. The optional two-bolt attachment at the forward end of the forward frame segment 226 will accommodate these thrusting stresses. A third mounting bolt 268 attaches the forward frame segment 226 to the base 214 rearward of the forward two mounting bolts 268.

The rearward frame segment 228 is attached to the base 214 through orifices 266, 267 at forward and rearward portions of the top walls 231 and 234 that align with nut studs 264 in the base 214. A pair of narrow, elongate, elastomeric bumpers 255 is provided in the base 214, disposed symmetrically on opposite sides of the nut stud 264 above the forward end of the rearward frame segment 228, and spaced to engage the upper portion of the stabilizing flanges 250 when the base 214 is in the lower, unflexed position shown in FIG. 11. The elastomeric bumpers 255 act as a shock absorber—for example, when the skate 210 transitions from the flexed to the unflexed position—and protects the bottom surface of the base 214 from undesirable wear that might otherwise result from repeated impacts and/or rubbing from the stabilizing flanges 250.

A greater number of wheels, such as five wheels, may be desired for greater speed. A fourth embodiment of a flexing base skate 310, constructed in accordance with the present invention, is shown in FIGS. 14-17. The skate 310 includes an upper shoe portion 312 that is attached to a flexible base 314, having a forefoot region 320 that includes a metatarsal head portion 322, and a heel region 324. The base 314 is attached to a split frame assembly 316 that supports five wheels 318 that are rotatably mounted on axles 345. The forward frame segment 326 includes a horizontal top wall 331, two parallel side walls 332 depending vertically from the top wall 331, and a horizontal brace 327 to form a sturdy box frame structure. The rearward frame segment 328 similarly includes a horizontal top wall 334, two parallel sidewalls 336, and a horizontal brace 327, also forming a sturdy box frame structure. Three forward wheels 318 are rotatably journaled on axles 345 between the sidewalls 332 of the forward frame segment 326, and two rearward wheels 318 are rotatably journaled on axles 345 between the sidewalls 336 of the rearward frame segment 328.

The forward frame segment 326 includes stabilizing flanges 350 depending rearwardly from the sidewalls 332 of the forward frame segment 326, and are spaced apart to slidably engage the forward portion of the sidewalls 336 of the rearward frame segment 328.

Figure 14:
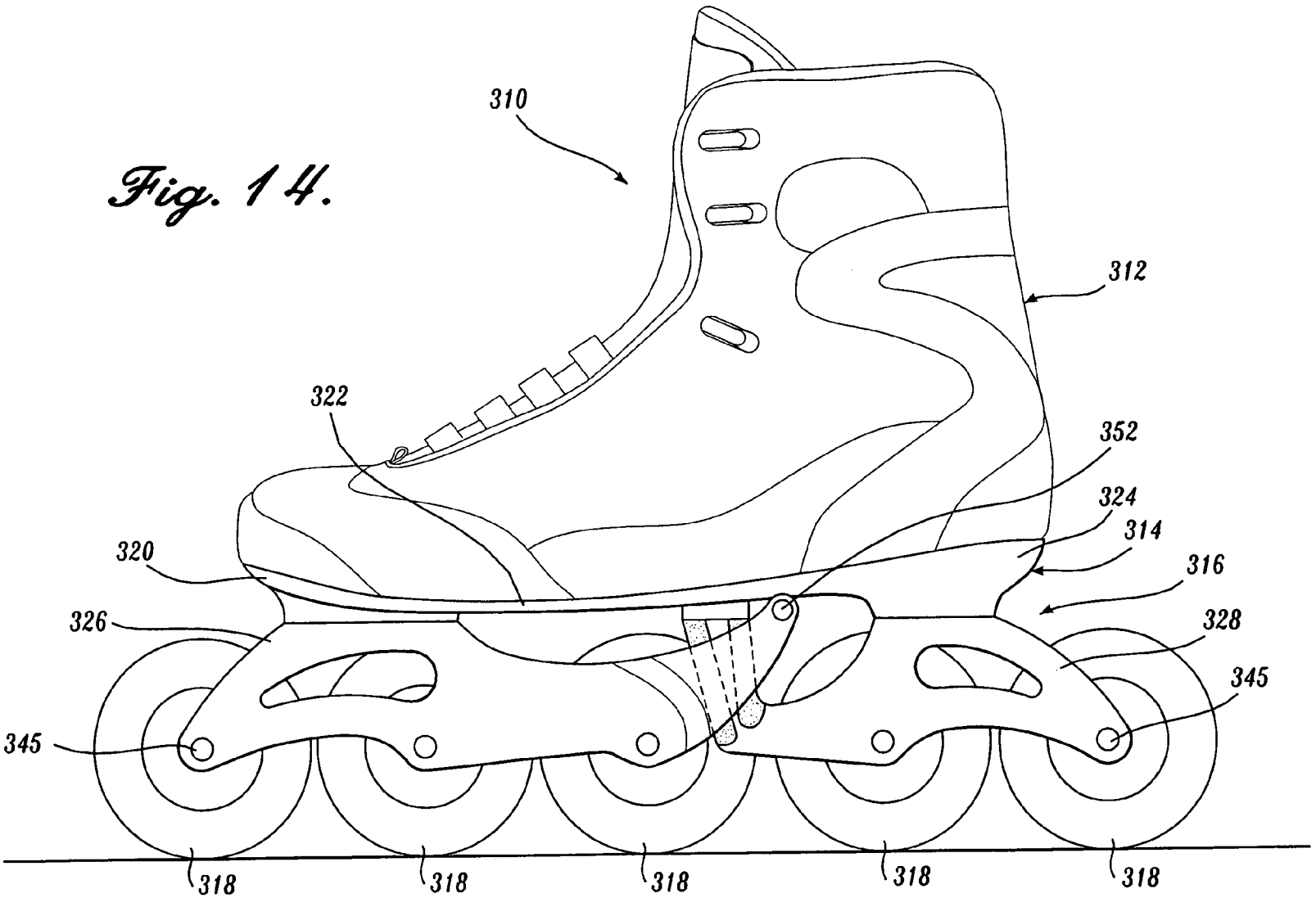
FIG. 14 provides a side view of a skate constructed in accordance with a fourth embodiment of the present invention, shown in an unflexed configuration.
Figure 15:
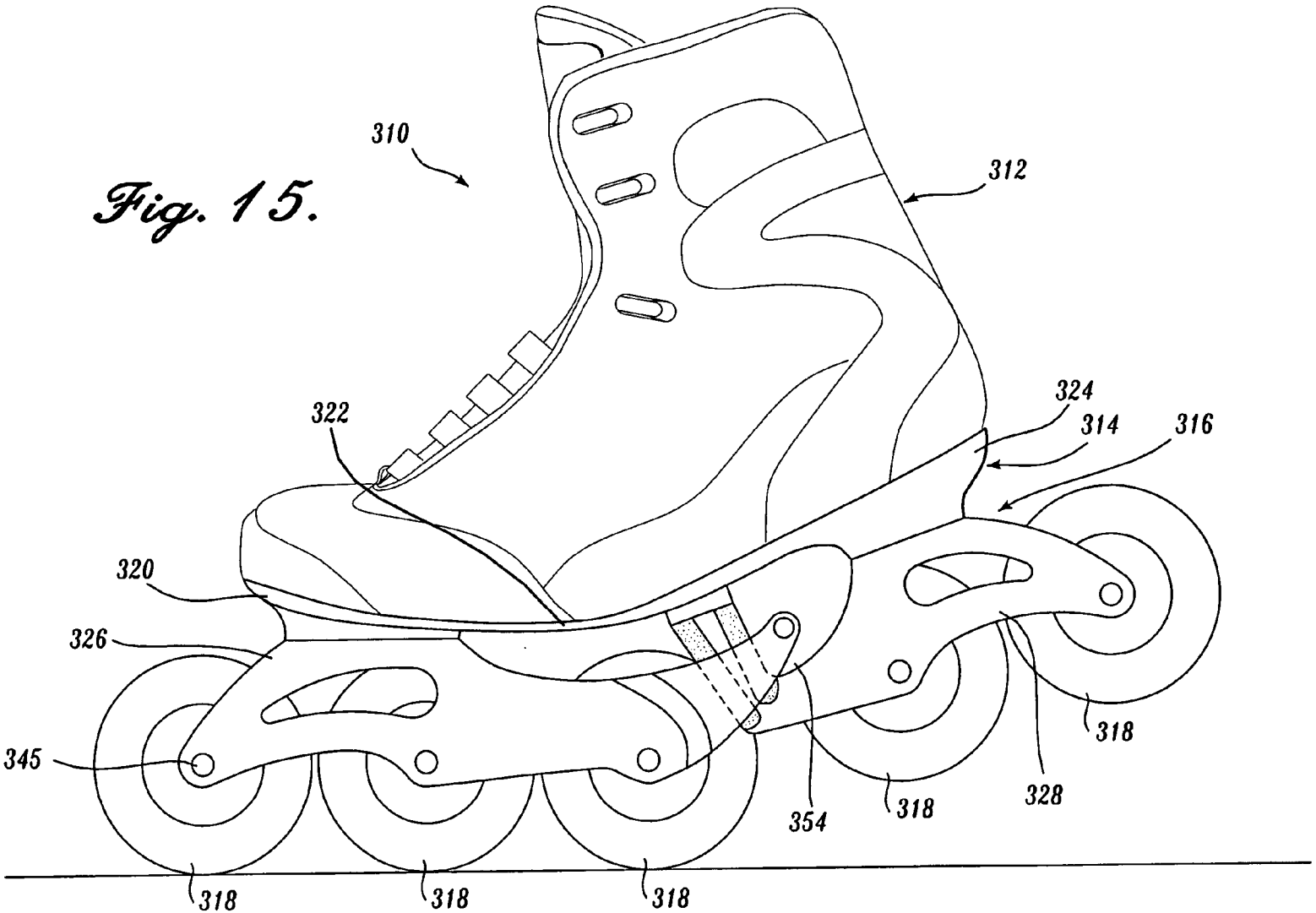
FIG. 15 provides a side view of the skate of FIG. 14 with the skate in the flexed configuration.

The skate 310 can flex from an unflexed, lower position shown in FIG. 14 to a flexed, upper position shown in FIG. 15. In the flexed position (generally produced during the skater's thrust stroke), the heel region 324 of the base 314 and the rearward frame segment 328 pivot with respect to the forefoot region 320 of the base 314 and the forward frame segment 326, lifting the two rearward wheels 318. Three wheels 318, therefore, remain in contact with the skating surface during the thrust stroke, providing a stable base for the skater. As with the previous embodiments, the base 314 is designed to preferentially flex in the metatarsal head portion 322 generally underlying the metatarsal head of the skater's foot. To further facilitate this sliding pivotal movement of the forward and rearward frame segments 326 and 328, low friction strips 356 are preferably applied to the exterior of the forward ends of each of the sidewalls 336 of the rearward frame segment 328.

The split frame assembly 316 attaches to the bottom side of the base 314 with a plurality of axially-spaced mounting bolts 368 that are inserted through slotted or circular apertures 366 in the top walls 331, 334 of the forward and rearward frame segments 326, 328. The mounting bolts 368 threadably engage nut studs 364 provided in the base 314. To further increase the torsional rigidity of the frame assembly 316, the stabilizing flanges 350 are reinforced by a transverse stabilizing pin 352 inserted through aligned apertures formed through the rearward edge portions of the flanges 350. The stabilizing pin 352 prevents the stabilizing flanges 350 from undesirably flaring outward or bending away from each other during use, maintaining them in spaced parallel disposition. The stabilizing pin 352 is accommodated by and passes through apertures 354 formed in the sidewalls of the rearward frame segment 328, between the points of attachment to the base 314 by bolts 368, within the upper portion of the sidewall.

Figure 16:
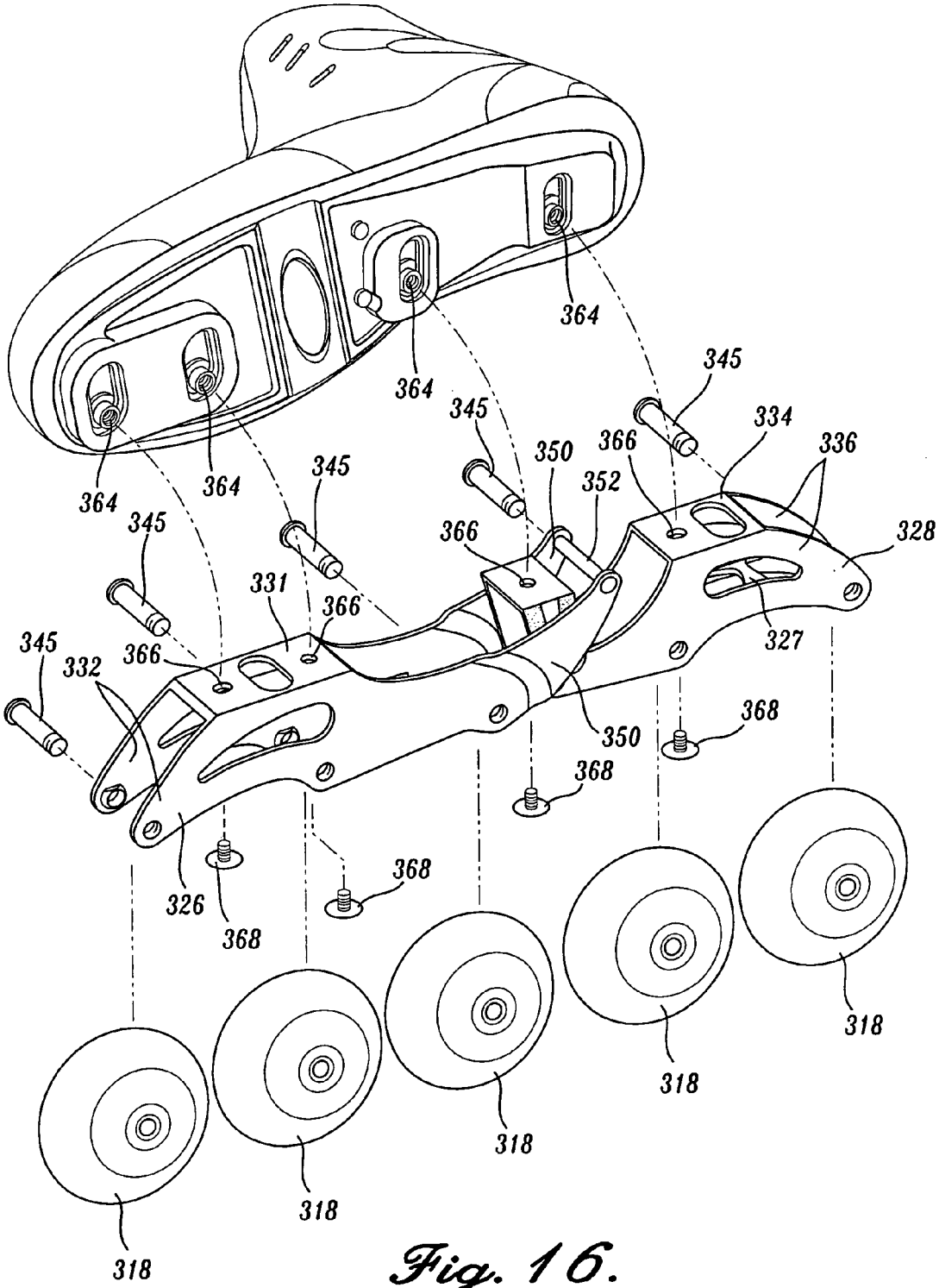
FIG. 16 provides an exploded pictorial view of the skate of FIG. 14.
Figure 17:
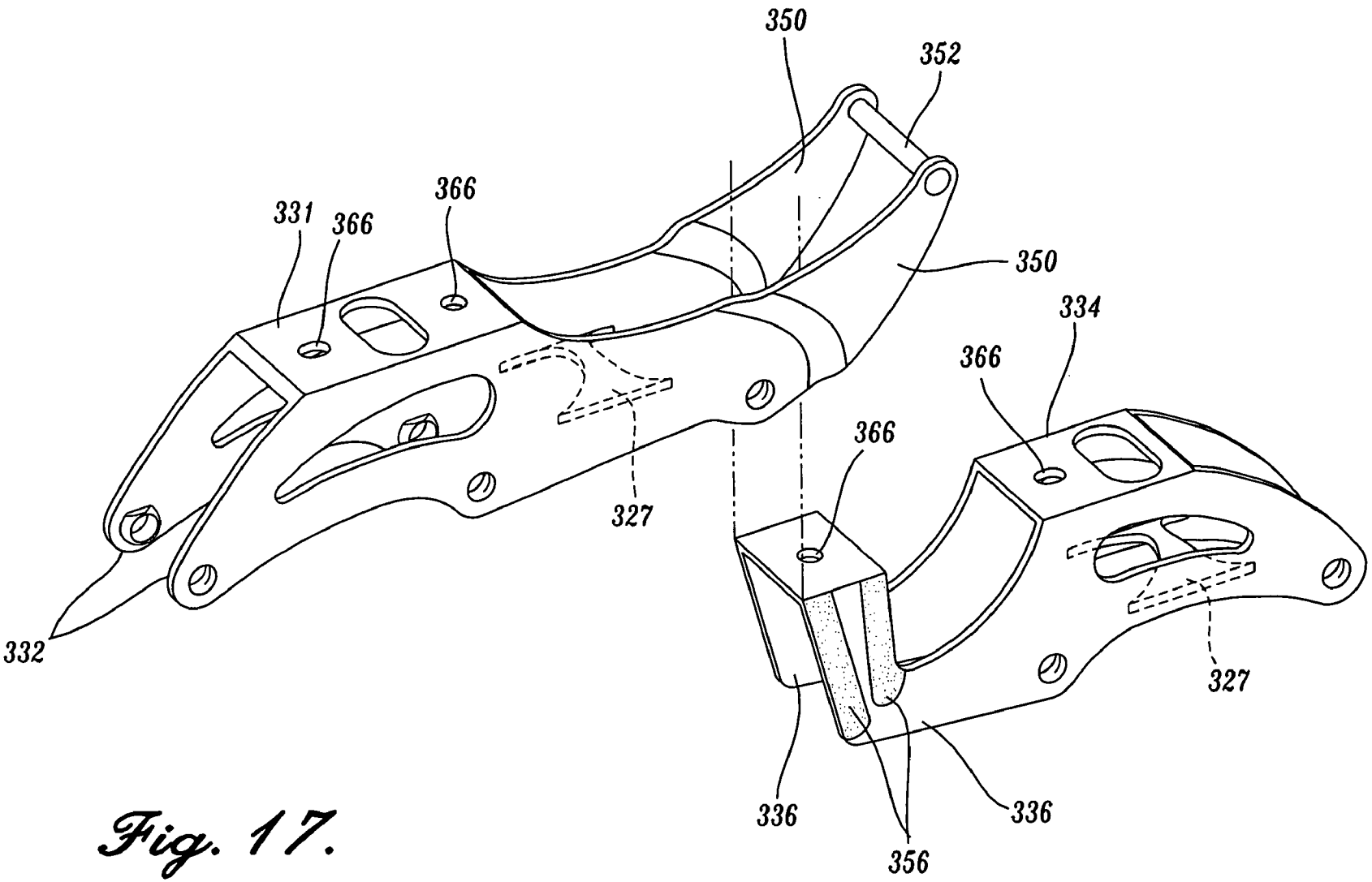
FIG. 17 provides an isometric view of the forward and rearward frame segments of the skate of FIG. 14.

Referring to FIGS. 14 and 16, the stabilizing pin 352, which connects the rearwardmost ends of flanges 350, is disposed rearwardly of the forwardmost point of connection of the rearward frame segment 328 by mounting bolt 368 through aperture 366 to the base 314. The stabilizing pin 352 is not connected to or engaged with the base 314 or to the rearward frame segment 328.

As in the prior embodiments, it should be apparent that the skate 310 could include two, rather than three, wheels in the forward frame segment 326; one wheel, rather than two, in the rearward frame segment 328; and the rearward frame segment overlapping the forward frame segment.

Figure 18:
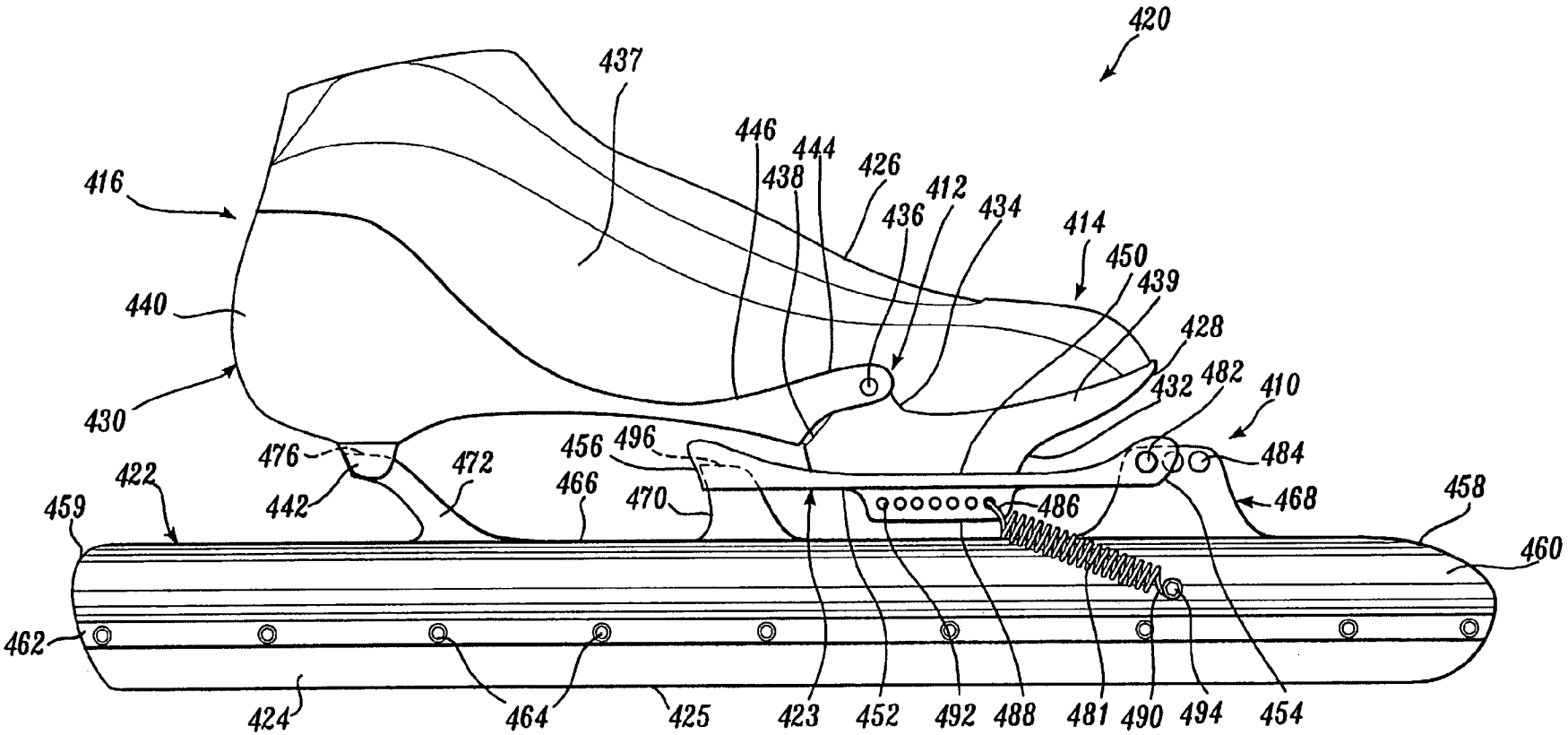
FIG. 18 is a double-hinged skate of the present invention attached to an ice blade, having a first hinge defined in the metatarsal portion of the boot and a second hinge defined substantially in the toe end of the boot.
Figure 19:
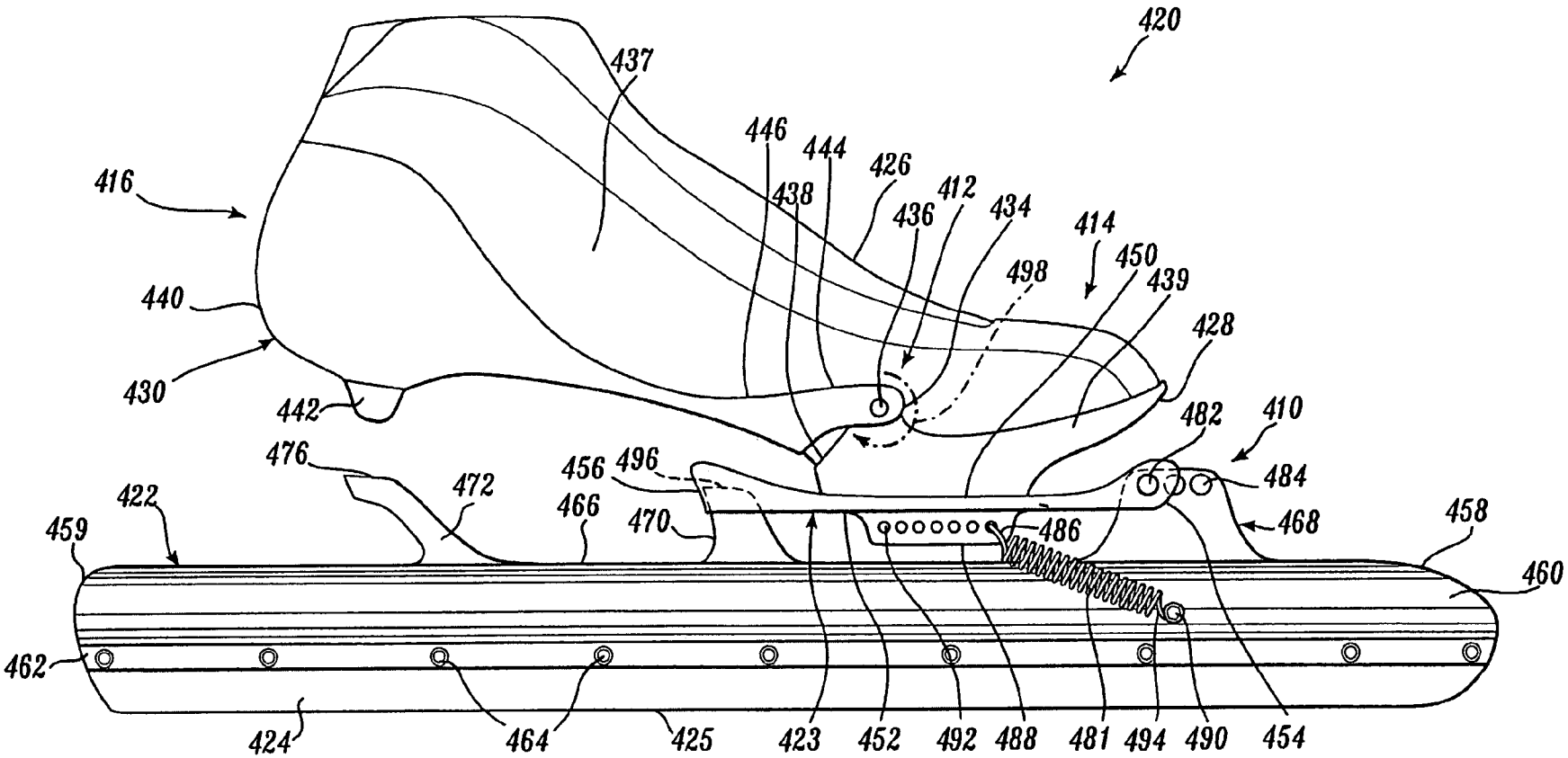

Referring to FIG. 18, a double-hinged athletic footwear constructed in accordance with one embodiment of the present invention is illustrated in the form of an ice speed skate 420. The skate 420 includes a frame 422, a forward hinge member 410, a midskate hinge member 412, and a bearing member in the form of an ice blade 424. Although the preferred embodiment of the bearing member is an ice blade 424, other types of skate bearing members capable of traversing a surface, such as an in-line roller skate, are also within the scope of the present invention.

The skate 420 includes an upper shoe portion 426 adapted to receive a foot (not shown), a fore foot base 428, and a rear foot base 430. The upper shoe portion 426 is preferably constructed from a flexible and durable natural or manmade material, such as leather or rubberized stretch nylon. The upper shoe portion 26 is fixedly attached to the fore and rear foot bases 428 and 430 by being secured beneath a last board (not shown) of the bases 428 and 430 by means well known in the art, such as glue or stitching. The upper shoe portion 426 also includes a conventional vamp and vamp closure, including a lace (not shown) or a zipper (not shown), extending along the top of the foot and from the toe area of the foot to the base of the shin of the skater. In the preferred embodiment, the upper shoe portion 426 is contoured closely to the foot of the skater for improved aerodynamics.

The fore and rear foot bases 428 and 430 are constructed in a manner well known in the art from a resilient composite material and are attached to the upper shoe portion 426 by an adhesive, such as glue. Suitable materials for the fore and rear foot bases 428 and 430 include semi-rigid fiber reinforced thermoplastic or thermo setting resins, such as carbon reinforced epoxy. Other semi-rigid or rigid materials may alternately be utilized. The forward base 428 extends from the toe end 414 of the upper shoe portion 426 to a predetermined distance behind the area of the upper shoe portion 426 that corresponds to the metatarsal head area of a received foot, hereinafter referred to as the metatarsal head area. It is preferred that the forward base 428 be molded to form a single composite structure having an upper surface (not shown) contoured to receive the fore foot of a skater and a lower surface. The lower surface has an integrally formed fore foot stem 432 depending downwardly therefrom.

The rear foot base 430, like the fore foot base 428, is preferably molded from a rigid or semi-rigid material, such as composites, having an upper surface (not shown) that is contoured to receive the heel midtarsal and metatarsal areas of a skater's foot. The rear foot base 430 includes a heel counter 440 and a heel mount 442. The heel counter 440 extends upwardly from the heel or rearward end of the rear foot base 430. The heel counter 440 surrounds and cups the heel portion 16 of the upper shoe portion 426 and provides lateral support to the heel of the skater. The heel counter 440 is preferably formed as an integral part of the rear foot base 430.

Still referring to FIG. 18, the fore and rear foot bases 428 and 430 are hingedly attached by the midskate hinge member 412. The midskate hinge member 412 is defined in the metatarsal head area of the skate 420 to permit the upper shoe portion 426 to flex about a laterally extending axis defined traversely to the longitudinal direction of the ice blade 424. In the preferred embodiment, the midskate hinge member 412 will pivot about an axis defined normal to the longitudinal direction of the ice blade 424. However, the axis of rotation of the midskate hinge member 412 is not so limited. As a non-limiting example, the rotational axis of the midskate hinge member 412 may follow the contour of the metatarsal heads of a skater's foot, thereby defining a rotational axis that is not normal to the longitudinal direction of the ice blade 424. Also, the center of rotation of the midskate hinge member 12 is defined substantially in the horizontal plane defined by the metatarsal heads of the skater's foot. Defining the center of the rotation axis at or substantially near the horizontal plane of the metatarsal heads is preferred because defining the rotational center too far below the metatarsal heads would cause the skater's foot to cramp. Therefore, in the preferred embodiment, the midskate hinge member 412 defines a rotational axis that is normal to the longitudinal direction of the ice blade 424 and has a center of rotation in the horizontal plane defined by the metatarsal heads of the skater's foot.

The midskate hinge member 412 includes a first hinge flange 434 defined on the fore foot base 428, and a first hinge arm 444 defined on the rear foot base 430. The hinge flange 434 is integrally formed from the lateral side 437 of the upper shoe portion 426, substantially near the metatarsal head area, and projects upwardly from the fore foot base 428. The hinge flange 434 includes an internally threaded bore (not shown) extending from the outside of the fore foot base 428 to partially through the thickness of the hinge flange 434. The threaded bore is adapted to threadably receive and fasten an externally threaded pivot screw 436 therein, to be described in greater detail below. A corresponding second hinge flange (not shown) and second threaded bore (not shown) are similarly formed from the medial side (not shown) of the fore foot base 428.

The toe end of the fore foot base 428 angles upwardly towards the toe end 414 of the upper shoe portion 426, so as not to interfere with the frame 422 during the skating stroke, while the rear end of the fore foot base 428, extending between the lateral and medial sides, is flat. The upper surfaces of the lateral and medial sides of the fore foot base 428, near the rearward end thereof, are angled forwardly towards the toe end 414 of the upper shoe portion 426 to define a beveled surface 438. The beveled surface 438 extends from the rear end of the fore foot base 428 to the apex (not shown) of the hinge flange 434, such that the sides of the fore foot base 428 do not interfere with the rear foot base 430 when the hinge flange 434 is hingedly attached to the first hinge arm 444.

The first hinge arm 444 is preferably formed as an integral projection of the rear foot base 430. In the preferred embodiment, the first hinge arm 444 projects forward of the metatarsal area and slightly upwards from the lateral side 446 of the rear foot base 430, so as to align adjacent with the hinge flange 434. The hinge arm 444 includes a laterally extending hole (not shown), the center of which is coaxial with the center of the threaded bore of the hinge flange 434. A pivot screw 436 is threadably received therein to pin the fore and rear foot bases 428 and 430 together, thereby defining the midskate hinge member 412. Alternate pivot mechanisms, such as a loosely received rivet (not shown) or a resilient polymeric hinge (not shown) could alternately be utilized. The hinge arm 444 is angled slightly outwards, away from the upper shoe portion 426, for proper pivotal movement between the fore and rear foot bases 428 and 430. A corresponding second hinge arm (not shown) and second hole (not shown) are similarly formed on the medial side (not shown) of the rear foot base 430. Thus, the midskate hinge member 412 hingedly connects the fore and rear bases 428 and 430 in the metatarsal head area of the skate 420 to permit the upper shoe portion 426 to hinge about a laterally extending axis defined normal to the longitudinal direction of the ice blade 424, to be described in greater detail below.

Still referring to the preferred embodiment of FIG. 18, the frame 422, suitably manufactured from aluminum or other rigid structural material, has a forward end 458, a rearward end 459, and includes an elongate tubular portion 460 and a downwardly depending flange portion 462. The flange portion 462 is integrally formed from the lower surface (not shown) of the tubular portion 460. The lower end of the flange portion 462 is bifurcated and the arms of which are spaced from each other to receive the upper end (not shown) of the ice blade 424 therebetween. The ice blade 424 is rigidly fastened within the flange portion 462 by well known fasteners 464, such as rivets or nuts and bolts.

The frame 422 also includes an attachment post 468, a midskate support post 470, and a heel support post 472. The attachment post 468 projects upwardly from the tubular portion 460 and is positioned near the forward end 458 of the frame 422, to be described in greater detail below. The midskate support post 470 projects upwardly from the tubular portion 460 at a predetermined distance behind the attachment post 468, and is located behind the metatarsal head area of the skate 420, also to be described in greater detail below.

The heel support post 472 projects upwardly from the tubular portion 460 and is positioned a predetermined distance behind the midskate support post 470. The heel support post 472 is configured as an inverted and elongate L-shaped member, with the spine of the heel support post 472 projecting upwardly from the tubular portion 460 and the base of the heel support post 472 positioned to receive the heel mount 442. The heel mount 442 is preferably shaped as an inverted U-shaped or V-shaped member and is rigidly attached beneath the heel end 416 of the skate 420 by well known fasteners (not shown), such as rivets, extending vertically through the base of the heel mount 442 and partially through the thickness of the rear foot base 430. The arms of the heel mount 442 are spaced from each other and extend downwardly to cup the heel support post 472 therein, such that the heel support post 472 supports and stabilizes the heel end 416 of the skate 420 without hindering the pivoting motion of the upper shoe portion 426 about the midskate hinge member 412. Although a combination heel support post 472 and heel mount 442 is the preferred embodiment, other single piece heel supports, such as an elongate heel mount 442 extending downwards to engage the frame 422, are also within the scope of the invention.

Still referring to the preferred embodiment of FIG. 18, the upper shoe portion 426 is hingedly attached to the frame 422 by the forward hinge member 410. The forward hinge member 410 includes a binding plate 423 and an adjustable first tension spring 481. The binding plate 423 has an upper surface 450, a lower surface 452, longitudinally spaced first and second ends 454 and 456, and is suitably manufactured from a high strength, lightweight rigid or semi-rigid material, such as aluminum or composites. The stem 432 of the fore foot base 428 is centrally received and fastened to the upper surface 450 of the binding plate 423 by fasteners well known in the art (not shown), such as rivets or nuts and bolts. Although the binding plate 423 and the fore foot base 428 are illustrated in the preferred embodiment as two separate pieces, a unibody construction, such as a binding plate 423 that is integrally formed with the fore foot base 428, is also within the scope of the invention.

In the preferred embodiment, the first end 454 of the binding plate 423 is in the shape of a U, with the attachment post 468 being releasably pinned between the arms thereof. The upper end of the attachment post 468 is fastened between the ends of the first end 454 by removable fasteners 482 well known in the art, such as a cotter pin or a screw. The fasteners 482 extend through a hole (not shown) defined through the thickness of the attachment post 468 and are received within horizontally extending holes (not shown) in the arms of the first end 454, thereby allowing the binding plate 423 to pivot about the fastener 482. Alternatively, the upper end of the attachment post 468 may be U-shaped, with a non-bifurcated first end 454 of the binding plate 423 releasably pinned therebetween, is also within the scope of the present invention.

The forward hinge member 410 is also adjustable in the longitudinal direction of the frame 422 by removing the fasteners 482 and sliding the binding member 423 either forward or rearward, relative to the forward and rearward ends 458 and 459 of the frame 422. The attachment post 468 includes a plurality of adjustment holes 484 laterally extending through the thickness thereof. The adjustment holes 484 allow the skater to adjust the position of the forward hinge member 410 relative to the forward and rearward ends 458 and 459 of the frame 422, thereby optimizing the skater's position on the frame 422. The fasteners 482 may then be reinserted, thereby locking the forward hinge member 410 into the desired location.

The upper shoe portion 426 is selectively adjustable between the lateral and medial sides of the frame 422. In the preferred embodiment, the binding plate 423 has at least one slot (not shown) extending between the lateral and medial sides thereof. The toe end 414 of the upper shoe portion 426 has at least one adjustment hole (not shown) extending vertically through the sole (not shown) and the fore foot stem 432. The position of the upper shoe portion 426 may be laterally adjusted between the lateral and medial sides of the frame 422 and locked into the desired position by well known fastening means, such as a screw, extending through the hole and received within the slot of the binding plate 423.

The tension spring 481 has a first end 486 that is releasably attached to an elongate first flange 488 disposed from the lower surface 452 of the binding plate 423 and a second end 490 that is attached to the lateral side of the frame 422. The second end 490 of the spring 481 is secured to the frame 422 by an arm 494 that projects outwardly from the lateral side of the frame 422. The second end 490 of the spring 481 is coiled around a groove (not shown) defined about the perimeter of the free end of the arm 494, thereby fastening the second end 490 to the frame 422. The first flange 488 is centrally located between the first and second ends 454 and 456 of the binding plate 423 and extends downwardly from the lateral side of the binding plate 423. The tip (not shown) of the first end 486 of the spring 481 is fastened to the flange 488 by extending the tip through one of a plurality of tensioning holes 492 extending through the thickness of the flange 488, and fastening the tip therein by well known fasteners. Although two tension springs is the preferred embodiment, a single spring centrally located between the lateral and medial sides of the frame 422 and extending to the underside of the binding plate 423, is also within the scope of the invention.

The degree of tension applied to the binding plate 423 by the spring 481 may be adjusted. By removing the first end 486 of the spring 481 from the tensioning hole 492 and pulling the first end 486 either forward or rearward, relative to the first and second ends 454 and 456 of the binding plate 423, and refastening the first end 486 into a different hole 492, the amount of tension may be increased or decreased. A corresponding second tension spring (not shown) and second arm (not shown) are similarly formed on the medial side (not shown) of the frame 422, such that first and second springs are adjustably fastened to both the lateral and medial sides of the skate 420. Thus, as fastened to the flange 488 and the arm 494, the spring 481 tensions the binding plate 423 into a closed position, wherein the second end 456 is urged downwardly against the midskate support post 470. Other biasing mechanisms, such as coil springs received on the fasteners 482 for hinged engagement with the binding plate 423 and frame 422, may alternately be utilized within the scope of the present invention.

As briefly noted above, the midskate support post 470 projects upwardly from the upper surface 466 of the frame 422. The midskate support post 470 is located substantially midway between the forward and rearward ends 458 and 459 of the frame 422. The upper surface 496 of the midskate support post 470 is adapted to receive and support the second 456 of the binding plate 423. In the preferred embodiment, the upper surface 496 is sized to be insertably received within a cavity (not shown) defined within the second end 56 of the binding plate 423, such that the second end 456 acts as a cap extending over the midskate support post 470. The cavity longitudinally extends within the second end 456 for a predetermined distance, such that when the forward hinge member 410 is adjusted along the attachment post 468, the second end 456 is slidable over the upper surface 496 of the midskate support post 470. Although it is preferred that the midskate support post 470 be insertably received within the second end 456 of the binding plate 423, other configurations are also within the scope of the invention. As a non-limiting example, the midskate support post 470 may be configured as an inverted Y-shape member projecting upwardly from the upper surface 466 and is sized such that the second end 56 of the binding plate 423 is received between the upwardly projecting arms of the midskate support post 470 and is seated in the arcuate portion thereof. As another non-limiting example, the midskate support post 470 may be eliminated altogether and the binding plate 423 may be extended along the sole to the heel portion 416, where it is received and supported by the heel support post 472.

While the shape of the midskate support post 470 is not important to the invention, the location of the midskate support post 470 relative to the upper shoe portion 426 is. Preferably, the midskate support post 470 is located behind the metatarsal head area of the upper shoe portion 426. However, in some versions of the invention it may be desirable to locate the midskate support post 470 slightly ahead of metatarsal head area, such that it engages the upper shoe portion 426 substantially near the vertical plane defined by the metatarsal head area of the upper shoe portion 426.

Locating the midskate support post 470 and supporting the binding plate 423 behind the metatarsal head area improves the efficiency of a skater's stroke because the skater can freely flex his or her foot at the midskate hinge member 412. By permitting skaters to plantarflex their foot, the skater is able push-off from the fore foot base 428, thereby intensifying the energy applied to the skate blade 424 during the skating stroke. Furthermore, by locating the midskate support post 470 and supporting the binding plate 423 behind the metatarsal head area, the midskate support post 470 and the binding plate 423 act in unison to provide skaters with a firm and stable platform from which to plant their fore foot and push-off. Catapulting would occur when the foot goes from a flexed position (heel in air, midskate on the midskate support post 470) to an extended position (heel in air, midskate off midskate support post 470 and boot extended).

Figure 19:
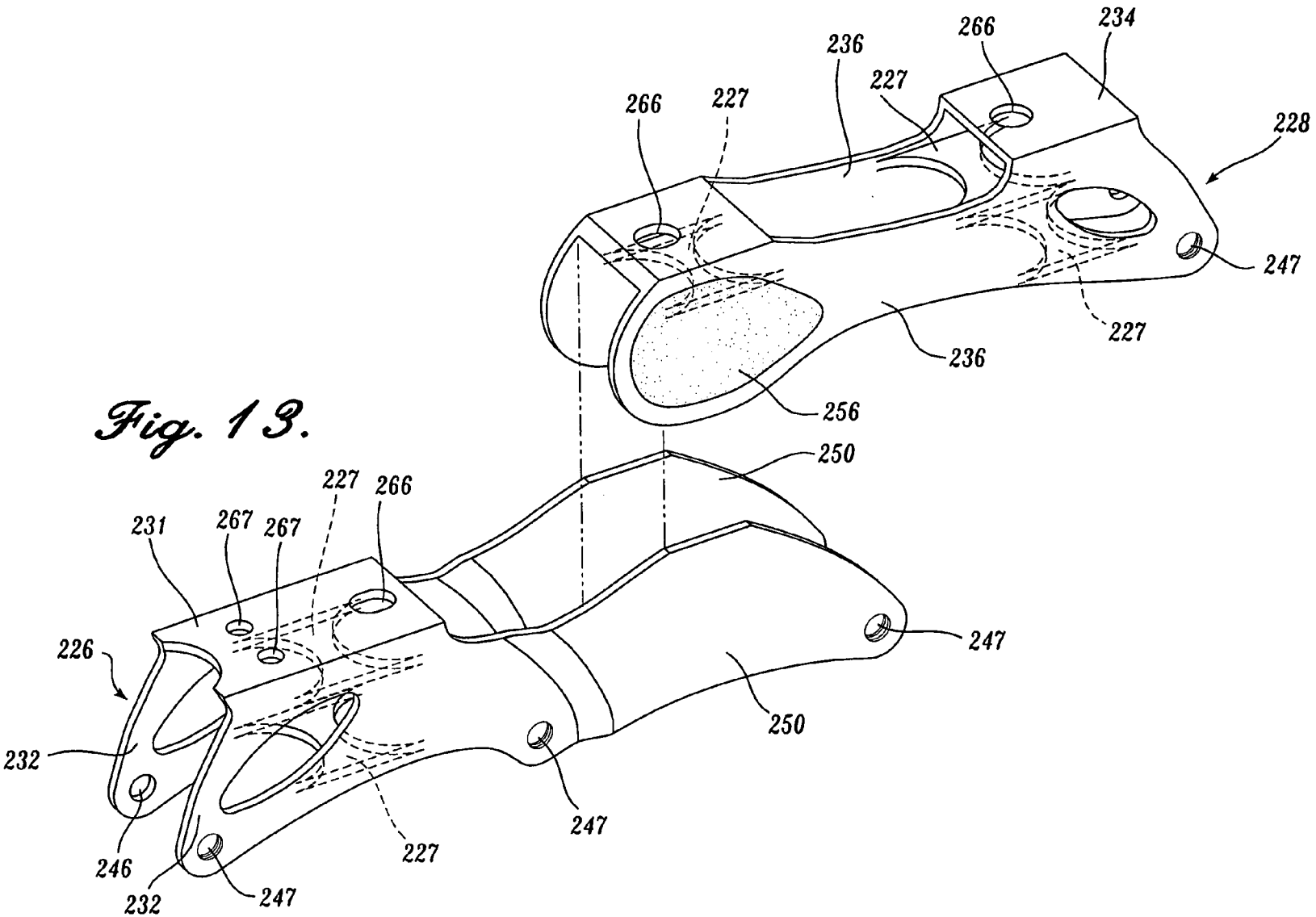
FIG. 19 is a side view of the double-hinged skate of FIG. 18 with the boot flexed around the first hinge member defined in the metatarsal portion of the boot to lift the heel end of the boot from the frame of the ice blade and the foot balancing on the forward portion of the foot from the metatarsal heads forward.
Figure 20:
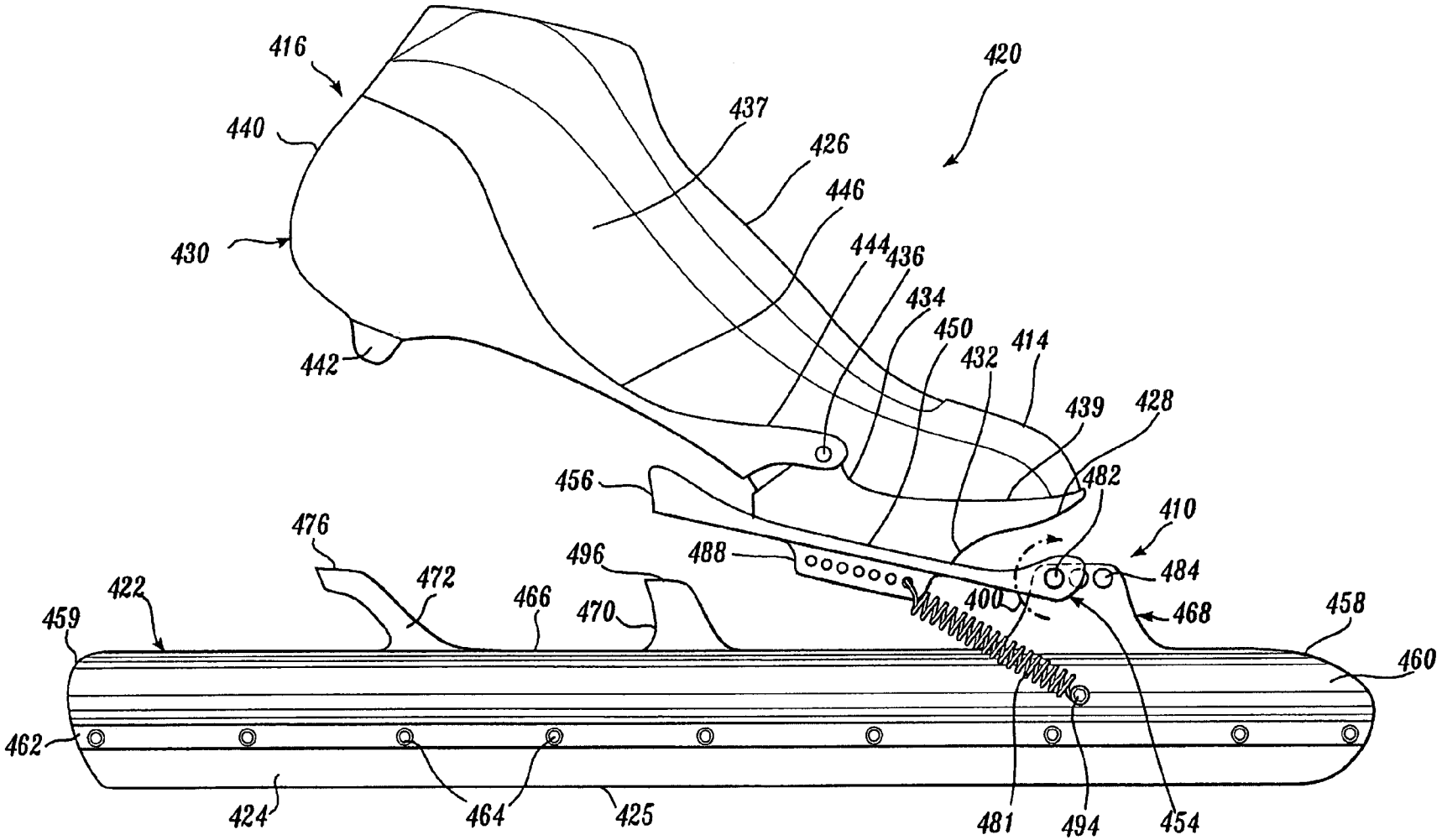
FIG. 20 is a side view of the double-hinged skate of FIG. 18 with the boot pivoting about the second hinge member defined substantially in the toe end of the boot, with the metatarsal head portion of the boot and first hinge member straightening out, thereby allowing maximum extension of the leg.

Operation of the skate 420 of the present invention may be best understood by referring to FIGS. 18-20. Generally, a skating stroke may be best described as having at least three distinct phases; a glide phase, a push-off phase, and a recovery phase.

The glide phase is seen in FIG. 18. During the glide phase of the skate 420 of the present invention, the lower surface 425 of the ice blade 424 is capable of traversing an ice surface (not shown). The midskate and forward hinge members 412 and 410 are unflexed, and the heel support post 472 and the midskate support post 470 are seated within the heel mount 442 and second end 456 of the binding plate 423, respectively. During the glide phase, the weight of the skater is supported by blade 424 as it is traversing the ice.

The push-off phase of the skating stroke may be best understood by referring to FIGS. 19 and 20. As the skater enters the push-off phase of the skating stroke, the skater begins to plantarflex his or her ankle and flex his or her foot about the midskate hinge member 412, thereby rotating the upper shoe portion 426 in a clockwise direction about the pivot screw 436, and as indicated by the arrow 498. As the upper shoe portion 426 pivots about the pivot screw 436, the skater lifts the heel end 416 of the upper shoe portion 426 from the frame 422, separating the heel mount 442 from the heel support post 472. Although the heel end 416 is separated from the frame 422, the toe end 414 of the skate 420 remains parallel with the longitudinal direction of the ice blade 424 and the entire length of the lower surface 425 of the ice blade 424 remains in full contact with the ice surface. During this initial part of the push-off phase, the skater's foot pivots at the metatarsal heads of the foot and the weight of the skater bears down on the forward base 428. As the skater bears down on the forward base 428, the midskate support post 470 and the binding plate 423 support the loads and provides the skater with a stable platform from which the skater is able to propel his or herself forward.

As the skater continues to plantarflex the ankle, thereby lifting the heel end 416 further from the frame 422, the skater transitions into the final part of the push-off phase, as seen in FIG. 20. During this part of the push-off phase, the skater further extends the leg, plantarflexes the ankle, but now extends the foot so the heel portion 416 rotates counterclockwise relative to the fore foot. This motion lifts the second end 456 from the midskate support post 470 and rotating the upper shoe portion 426 in a clockwise direction about the fastener 482, and as indicated by the arrow 400. The entire length of the lower surface 425 of the ice blade 424 remains in contact with the ice surface during the final part of the push-off phase of the skating stroke. During the recovery phase of the skating stroke, the lower surface 425 of the blade 424 is no longer in contact with the ice. The tension spring 81 returns the binding plate 423 to the midskate support post 470. The boot spring returns the rear and fore foot sections of the boot to their gliding position with the heel mount 442 in contact with the heel support post 472. The forward and midskate hinge members 410 and 412 permit the skater to plantarflex his or her ankles during the push-off phase of the skating stroke, thereby permitting the calf muscles to fully extend and generate greater speed, as well as reducing the risk of digging the tip end of the blade 424 into the ice.

Although mechanically pinning the hinge arm 444 to the hinge flange 434 is the preferred embodiment for the midskate hinge member 412, as seen in FIG. 18, alternate embodiments of the midskate hinge member 412 are also within the scope of the invention.

Figure 21:
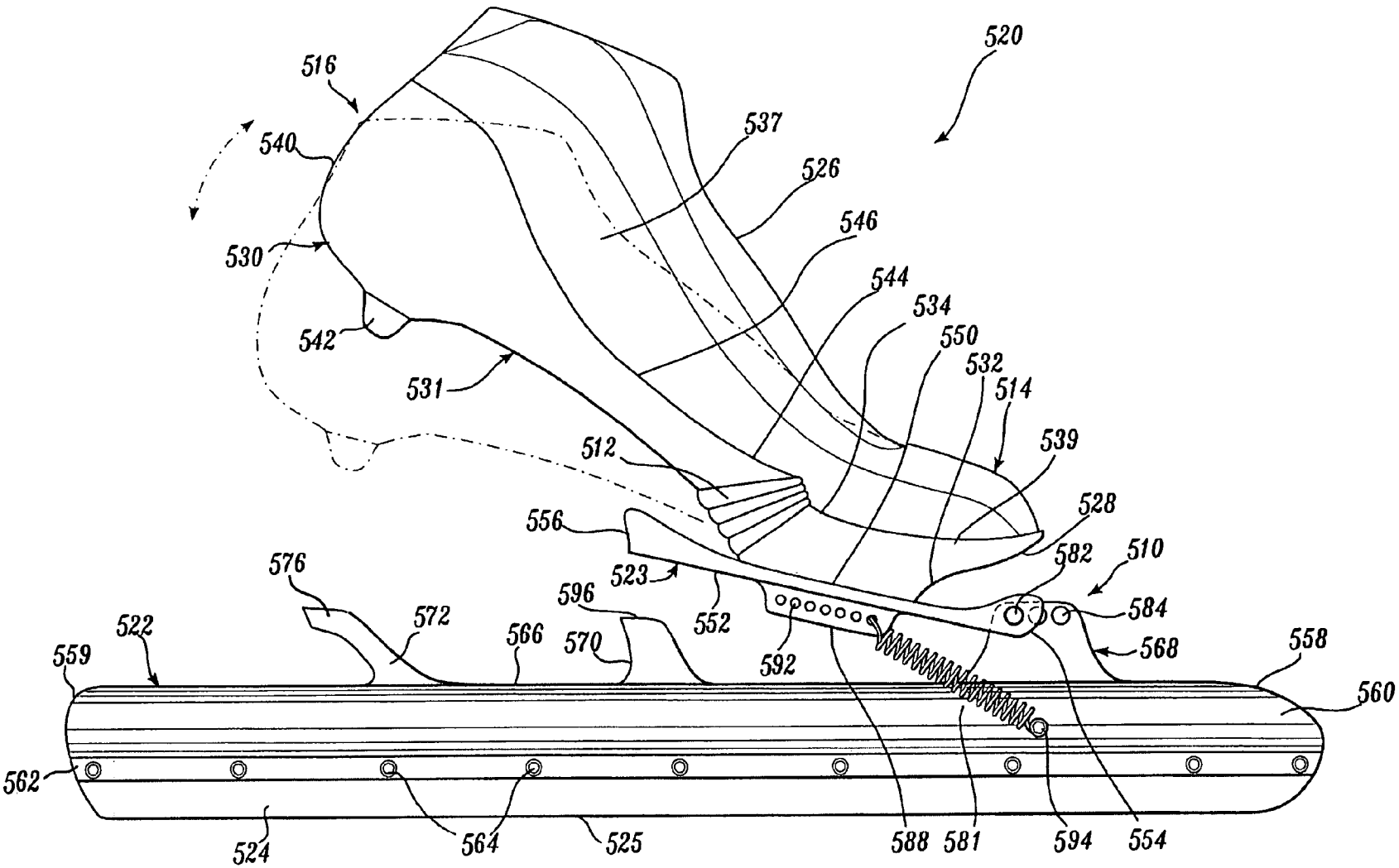
FIG. 21 is a side view of an alternate embodiment of the double-hinged skate of the present invention, showing the first hinge member as an integral flexing member to permit the metatarsal head area of the boot to freely flex.

As seen in FIG. 21, an alternate midskate hinge member 512 may be configured as a composite or elastomeric hinge. In this alternate embodiment, the skate 520 includes a single piece base 531 or multipiece assembly extending from the toe end to the heel end of the upper shoe portion 526. Integral with the base 531, and defined in the metatarsal head area of the upper shoe portion 526, is the midskate hinge member 512. The midskate hinge member 512 is formed from a composite or elastomeric material and extends from the lateral side of the base 531, along the sole (not shown) of the base 531, and upwardly along the medial side (not shown) of the base 531. The composite midskate hinge member 512 is formed as a resilient bellows-type joint and becomes loaded when flexing during the push-off phase of the skating stroke, and it releases to return to its natural position during the recovery phase. Otherwise, the skate 520 of FIG. 4 is similar in construction and use as described above for the preferred embodiment.

From the foregoing description, it may be seen that the skate of the present invention incorporates many novel features and offers significant advantages over those currently available in the art. It will be apparent to those of ordinary skill that the embodiments of the invention illustrated and described herein are exemplary only. As a first non-limiting example, the forward and rearward bases 428 and 430 of the preferred embodiment may be replaced with a single or two plates embedded into the sole of the upper shoe portion 426. In this non-limiting example, the midskate hinge member 412 would be defined in the sole of the upper shoe portion, in the metatarsal head area thereof. As a second non-limiting example, and although it is preferred that the frame 422 is formed as a single structure, a split frame and bearing member having a first section hingedly attached to the toe end 414 of the upper shoe portion 426 and a second end rigidly attached to the heel position 416, such that the second end hinges with the heel portion 416 during use, is also within the scope of the invention. Therefore, changes may be made to the foregoing embodiments while remaining within the spirit and scope of the present invention.

Figure 22:
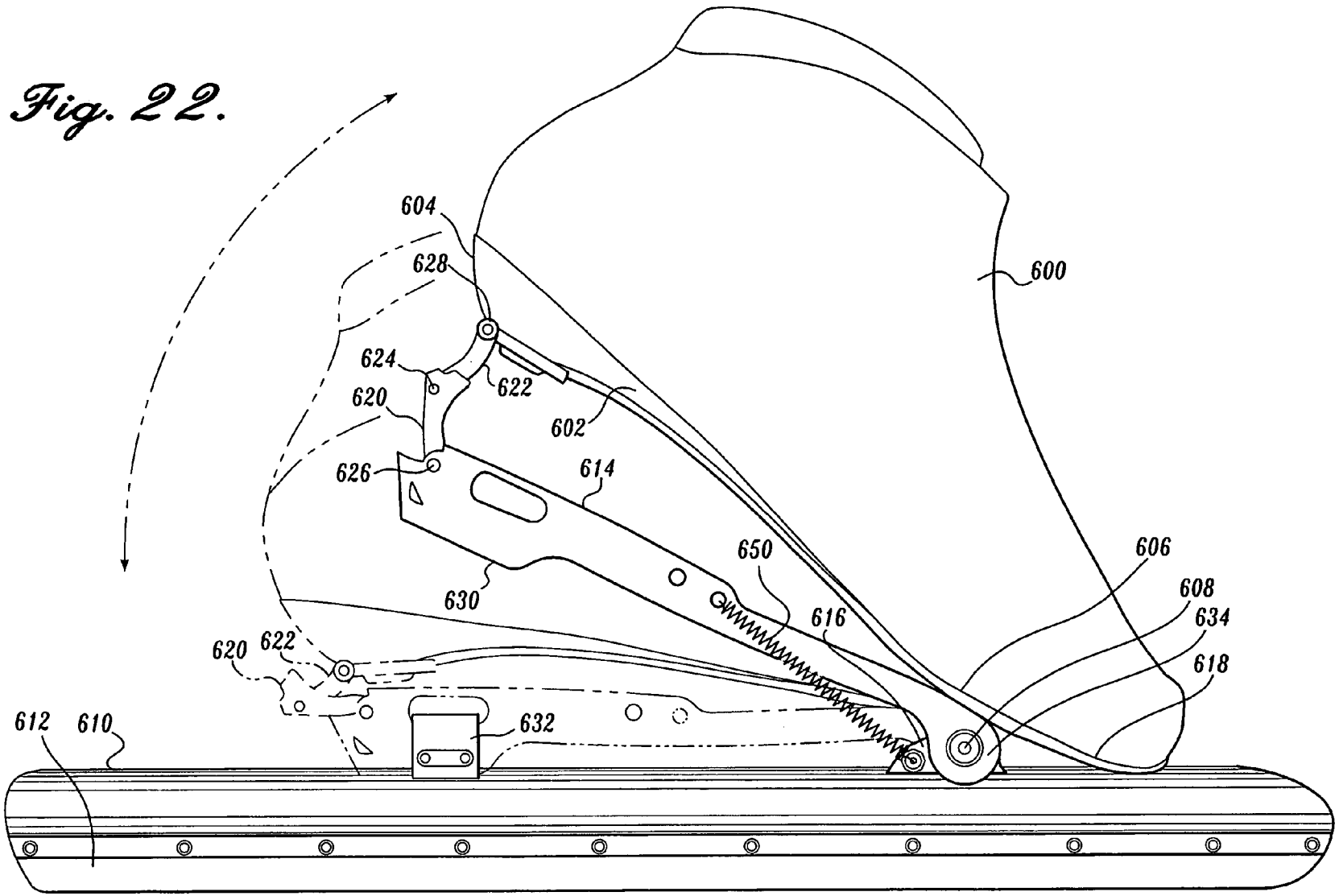
FIG. 22 is a side view of the double-hinged skate of the present invention with the boot pivoting at a first and second hinge, and additionally at a third heel hinge to provide lateral stability.

Referring now to FIG. 22, an alternate embodiment of a skate includes a first midskate hinge defined in the metatarsal area of the shoe base, a second forward hinge that pivotally attaches the shoe to the skate frame and a third heel hinge that connects the rear of the shoe base to the rear of an elongated binding plate. The ice skate includes a shoe portion 600 with a shoe base 602 attached to the underside of the shoe portion 600, and a pivoting-type klap skate mechanism that includes an elongated binding plate 614. The shoe base 602 is attached to the binding plate 614 at the front of the shoe base 602. The binding plate 614 is attached to the frame 610 at the front of the frame 610. The frame 610 supports the blade 612 for gliding across ice surfaces. However, in-line wheels can be provided instead of the blade 612. The binding plate 614 is attached to the frame 610 via the post 616 at the front of frame 610. The binding plate 614 includes an elongated rigid member having a transversely mounted barrel 634 that is split to receive the upright post 616 between the respective halves of the barrel 634. The axle 608 is inserted transversely through the center of the barrel 634 and through an aperture in the post 616 to enable a swinging motion to the binding plate 614. Additionally, the binding plate 614 may be biased against the frame 610 by the spring 650 connected to the upright post 616 and the binding plate 614 at approximately the midpoint of the binding plate 614. The function of spring 650 is to bias the frame 610 and binding plate 614 together, such as after completing the push-off stroke. In one embodiment, the spring 650 may have a stiff spring constant such that the shoe base 602 preferentially flexes before the entire shoe 600 flexes at front hinge. The back end of the binding plate 614 includes a downwardly projecting binding plate shoe 630 which comes to rest on the binding plate pad 632 during the gliding phase of the skate stroke. The binding plate pad 632 is attached to the upper area of the frame 610 toward the rear end of the frame 610. In the gliding phase, the binding plate shoe 630 will rest securely on the binding plate pad 632 as shown in FIG. 22 in phantom. The back end of the binding plate 614 is connected to the back end of the shoe base 602 through a heel hinge, which includes a first bottom arm 620 and a second top arm 622, connected to one another in a pivoting manner. The bottom arm 620 has a lower portion that is connected to the rear end of the binding plate 614 via the axle 626. Binding plate 614 may have a split or groove into which a slender portion of arm 620 may be inserted, or the groove may be provided on arm 620, and binding plate 614 would have a slender portion to fit therein. Connections between shoe base 602, arm 622, arm 620, and binding plate 614 may have a similar structure to enable a rotating motion. The top of the bottom arm 620 is connected to the bottom of the top arm 622 via the axle 624. The top of the top arm 622 is connected to the bottom of the heel portion 604 of the shoe base 602 via the axle 628. The solid lines show the skate in the push-off phase of the skating stroke. To return to the gliding phase shown in phantom, the bottom arm 620 rotates counterclockwise about the axle 626 so that the bottom arm will generally lie parallel to the skate frame 610. The top arm 622 rotates clockwise about the axle 624 and comes to rest on top of the bottom arm 620. The top arm 622 rotates clockwise about the axle 628.

A double-hinged skate includes a first and second hinge, wherein one hinge is a midskate hinge at the metatarsal area 606, positioned in or integral with the shoe base 602, and the second hinge is located at the front of the skate and connects the frame 610 to the shoe base 602. However, having two hinges generally located toward the front of the skate may result in rear lateral instability. A small rotation in the plane parallel to the ground about the midskate hinge or forward hinge magnifies the amount of rotation at the back of the shoe 600, thereby introducing lateral instability and discomfort that decreases the thrusting capabilities of a skate. The present invention solves the problem by providing a third heel hinge to stabilize the rear end of the shoe and provides lateral stability. According to the present invention, a heel hinge is provided that connects the back of the binding plate 614 to the back of the shoe 600 to provide lateral stability to the back of the shoe and skate by reducing the amount of twisting of the shoe. The shoe 600 according to the present invention includes a shoe base 602 having a metatarsal head portion 606. At about the region defined by the metatarsal head portion 606, the base 602 includes a midskate hinge that allows the skater to preferentially flex the shoe base 602 at the metatarsal head portion 606, while maintaining the front toe portion 618 of the base 602 substantially parallel with the binding plate 614 and the heel portion 604 of the shoe base 602 will rise in relation to the binding plate 614. The metatarsal head portion 606 can include any of the previously described flexing bases having a midskate hinge. For example, the base 602 at the metatarsal head portion 606 can have a reduced thickness base portion traverse to the length of base to preferentially flex at the metatarsal head portion, such as in the embodiment of FIGS. 6-8. Alternatively, the metatarsal head portion 606 may include a transverse, elongate aperture to preferentially flex at the metatarsal head portion 606 of the base 602 such as the embodiment of FIGS. 1-5, or FIGS. 10-12. Alternatively, the shoe base can be constructed from a first, front shoe base portion and a second, rear shoe base portion, both substantially rigid and inflexible, but connected to each other via a midskate hinge, such as the embodiment of FIGS. 18-20. Alternatively, the metatarsal head portion 606 of shoe base 602 can be provided with an elastomeric or composite, midskate, bellows hinge to allow for preferentially flexing the base 602 at about the metatarsal head portion 606, such as the embodiment of FIG. 21. Any of the herein described flexing bases with midskate hinges can be utilized with the embodiment of the invention represented by FIG. 22, including a heel hinge. Conversely, any of the klap skates described herein can be configured with a heel hinge to connect the back of the shoe to the back of the binding plate. A klap skate generally provides a skate with the ability to raise the skate shoe heel in relation to the skate frame rear.

Furthermore, the heel hinge in accordance with the invention provides a way of flexing the shoe base 602, before flexing the shoe 600, as a whole, at the front of the frame 610 with respect to a horizontal surface. Thus, the sequencing of the shoe base flexing at the metatarsal area 606 and the flexing of the shoe 600, as a whole, can be controlled. The heel hinge made from arms 620 and 622 has a limited amount of travel, such that when the limit of travel is reached, flexing of the shoe base 602 in the metatarsal area 606 will cease, because the shoe base 602 is mechanically linked to the back of the binding plate 614 through the heel hinge, and the shoe base 602 cannot flex beyond the limit of travel of the heel hinge. When the limit of travel is reached, and the shoe base 602 ceases to flex, further ankle plantar flexing results in flexing of the shoe 600, as a whole, at the front hinge, so that the binding plate 614 will begin to pivot at the front of the frame 610, about the axle 608. By determining the amount of travel of the heel hinge, the desired amount of flex in the metatarsal region 606 of the shoe base 602, can be controlled. Being able to sequence the flexing of the metatarsal region 606 of the shoe base 602 first, followed by flexing the shoe 600, as a whole, at the front of the frame 610 is further enabled by having a stiff spring 650 that biases the binding plate 614 toward the frame 610, to hold the binding plate 614 against the frame 610 to prevent premature flexing at the forward hinge about the axle 608, and to ensure that flexing of the shoe base 602 at the metatarsal region 606 occurs before flexing of the shoe 600, as a whole, at the front of the frame 610, about axle 608.

As with the previous embodiments, the embodiment illustrated in FIG. 22 is designed to preferentially flex at the base 602 in the metatarsal head portion 606 that generally underlies the metatarsal heads of the skater's foot.

The previously described versions of the present invention provide several advantages over skates currently available in the art. The skate of the present invention provides a midskate hinge member defined in the metatarsal head area of the upper shoe portion and a forward hinge member that pivotally attaches the skate shoe to the skate frame. The midskate and forward hinge members permit the skate to flex in both the metatarsal head area and the toe area of the boot. Additionally, connecting the rear of the shoe to an elongated binding member, via a hinge as in the embodiment of FIG. 22, provides lateral stability. This allows a natural motion of the lower limb segments during skating while providing stable control of the blade. The skate of the present invention also has the added advantage of permitting the ankle to plantarflex during the skate stroke, thereby permitting a skater to generate more power and, thus, speed. Additionally, this skate prevents the tip of the blade from digging into the ice during ankle plantar flexion of the skate stroke. The skate of the present invention is also lighter in weight than those currently available in the art. Thus, these advantages combine to define a skate having a double-hinge attachment design to permit skaters to plantarflex their ankle to generate more power and speed without the tip of the blade digging into the ice. While described herein in the preferred embodiment of an ice skate, the present invention can be readily adapted based on the disclosure contained herein for an in-line roller skate.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A skate, comprising:

(a) a shoe having a shoe base defining a front and back shoe base portion;

(b) a binding member defining a front and back portion, wherein the front portion of the shoe base is connected to the front portion of the binding member;

(c) a frame defining a front and back frame portion, wherein the frame supports gliding means, and the front portion of the frame is connected to the front portion of the binding member;

(d) a first hinge between the front shoe base portion and the back shoe base portion to permit the back of the shoe to be raised in relation to the back of the binding member;

(e) a second hinge between the front of the binding member and the front of the frame to permit the back of the binding member to be raised in relation to the back of the frame; and (f) a third hinge located between the back of the shoe base and the back of the binding member to stabilize the back of the shoe as the back of the shoe is raised in relation to the back of the binding member.

2. The skate of claim 1, wherein the skate comprises a front and rear shoe base portion connected to one another via a midskate hinge.

3. The skate of claim 1, wherein the skate comprises a shoe base that preferentially flexes at the metatarsal area.

4. The skate of claim 1, wherein the skate comprises a shoe base having a transverse elongated aperture at about the metatarsal area to preferentially flex the shoe base at the metatarsal area.

5. The skate of claim 1, wherein the skate comprises a shoe base having a unitary base with a reduced thickness at about the metatarsal area to preferentially flex the shoe base at the metatarsal area.

6. The skate of claim 1, wherein the skate comprises a shoe base having an elongated transversely positioned aperture at about the metatarsal area to preferentially flex the shoe base at the metatarsal area.

7. The skate of claim 1, wherein the skate comprises a shoe base having an elastomeric or composite bellows-type joint at about the metatarsal area to preferentially flex the shoe base at the metatarsal area.

8. The skate of claim 1, wherein the gliding means comprise a plurality of in-line wheels or a blade.

9. The skate of claim 1, wherein the third hinge comprises a first and second arm, wherein one arm connects to the back of the binding member, one arm connects to the back of the shoe base, and the first and second arms are connected to each other.

10. A klap skate, comprising:

a frame having one or more gliding means for traversing across a surface;

a shoe with a shoe base attached to the frame via a klap frame member;

the shoe base preferentially flexes at about the metatarsal area so that the shoe base flexes to create a first separation distance between the klap frame member and the shoe base, wherein the rear of the shoe base is connected to the rear of the klap frame member; and the klap frame member extending generally the length of the shoe base and pivotably attached to the front of the frame so that the klap frame member pivots to create a second separation distance between the frame and the klap frame member, wherein the separation of the rear of the shoe base with the frame is the combined first and second separation distances.

11. The skate of claim 10, wherein the skate comprises a front and rear shoe base portion connected to one another via a midskate hinge.

12. The skate of claim 10, wherein the shoe base flexes before the klap frame member pivots.

13. The skate of claim 10, wherein the shoe base includes a transverse elongated aperture at about the metatarsal area to preferentially flex the shoe base at the metatarsal area.

14. The skate of claim 10, wherein the shoe base comprises a unitary base with a reduced thickness at about the metatarsal area to preferentially flex the shoe base at the metatarsal area.

15. The skate of claim 10, wherein the shoe base includes an elongated transversely positioned aperture at about the metatarsal area to preferentially flex the shoe base at the metatarsal area.

16. The skate of claim 10, wherein the shoe base comprises an clastomcric or composite bellows-type joint at about the metatarsal area to preferentially flex the shoe base at the metatarsal area.

17. The skate of claim 10, wherein the gliding means comprise a plurality of in-line wheels or a blade.

18. The skate of claim 10, further comprising a hinge having a first and second arm, wherein one arm connects to the back of the klap frame member, one arm connects to the back of the shoe base, and the first and second arms are connected to each other.

19. An ice skate, comprising:

(a) a shoe that preferentially flexes at about the metatarsal area;

(b) a frame that supports a blade;

(c) a pivoting member that is connected to the front of the frame, and wherein the front of the shoe is connected to the front of the pivoting member; and (d) a linkage that connects the back of the shoe to the back of the pivoting member.

20. A skate, comprising:

(a) a shoe having a shoe base defining a front and back shoe base portion;

(b) a binding member defining a front and back portion, wherein the front portion of the shoe base is connected to the front portion of the binding member;

(c) a frame defining a front and back frame portion, wherein the frame supports gliding means, and the front portion of the frame is connected to the front portion of the binding member;

(d) a first hinge between the front shoe base portion and the back shoe base portion to permit the back of the shoe to be raised in relation to the back of the binding member;

(e) a second hinge between the front of the binding member and the front of the frame to permit the back of the binding member to be raised in relation to the back of the frame; and (f) wherein the first hinge is configured to preferentially flex a predetermined amount before substantial flexing of second hinge occurs.

21. The skate of claim 13, wherein the back of the shoe base and the back of the klap frame member are connected to each other.

22. A method for sequencing the operation of a double-hinged skate having a midskate hinge that allows flexing of the shoe base at the metatarsal region, and a forward hinge that allows pivoting of a binding plate on which the shoe rests, the method comprising connecting the rear of the shoe base to the binding plate to limit the amount of flex at the shoe base metatarsal region to allow raising the rear of the shoe base from a resting position to a raised position in relation to the rear of the binding plate before allowing pivoting of the binding plate from a resting position to a raised position.

23. The skate of claim 1, wherein the skate is configured to flex at the first hinge before the second hinge.

24. The skate of claim 10, wherein the skate is configured to flex at the metatarsal area before pivoting of the klap frame member.

* * * * *

UNITED STATES PATENT AND TRADEMARK OFFICE

CERTIFICATE OF CORRECTION

PATENT NO. : 7,419,187 B2
APPLICATION NO. : 11/084178
DATED : September 2, 2008
INVENTOR(S) : D. J. Haugen et al.

It is certified that error appears in the above-identified patent and that said Letters Patent is hereby corrected as shown below:

| COLUMN | LINE | ERROR |
|---|---|---|
| 30 (Claim 16, | 2 line 2) | "clastomcric" should read --elastomeric-- |

Signed and Sealed this

Thirteenth Day of April, 2010

David J. Kappos

David J. Kappos
*Director of the United States Patent and Trademark Office*